US012643020B1

(12) United States Patent
McNamara et al.

(10) Patent No.: US 12,643,020 B1
(45) Date of Patent: Jun. 2, 2026

(54) GOLF BALL ALIGNMENT AND REGISTRATION IN A TRANSPORTATION SYSTEM

(71) Applicant: Acushnet Company, Fairhaven, MA (US)

(72) Inventors: Michael McNamara, Fairhaven, MA (US); Jedediah H. James, Dighton, MA (US); Edmund T. Maher, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/774,101

(22) Filed: Jul. 16, 2024

Related U.S. Application Data

(63) Continuation-in-part of application No. 17/552,624, filed on Dec. 16, 2021, now Pat. No. 12,472,405.

(51) Int. Cl.

| | |
|---|---|
| ***A63B 57/20*** | (2015.01) |
| ***A63B 45/02*** | (2006.01) |
| ***B65G 17/00*** | (2006.01) |
| ***B65G 25/06*** | (2006.01) |

(52) U.S. Cl.
CPC ..... *A63B 57/20* (2015.10); *A63B 45/02* (2013.01)

(58) Field of Classification Search
None
See application file for complete search history.

(56) References Cited

U.S. PATENT DOCUMENTS

| | | | | |
|---|---|---|---|---|
| 1,721,965 | A | 7/1929 | McGinness | |
| 2,640,580 | A * | 6/1953 | De Burgh | B65G 17/002 104/178 |
| 4,982,556 | A | 1/1991 | Tisma | |
| 6,253,684 | B1 * | 7/2001 | Summa | B61B 10/025 104/251 |
| 10,086,626 | B1 | 10/2018 | Herrmann | |
| 10,328,718 | B2 | 6/2019 | Condello | |
| 2010/0186610 | A1 | 7/2010 | Polk | |

FOREIGN PATENT DOCUMENTS

| | | |
|---|---|---|
| DE | 102015203798 | 10/2015 |

* cited by examiner

*Primary Examiner* — Kavel Singh
(74) *Attorney, Agent, or Firm* — Steven Landolfi, Jr.

(57) ABSTRACT

A system for transporting a golf ball on at least one track has a shuttle and a golf ball holder attached to the shuttle. The shuttle is configured to be attached to the track for movement along the track in a travel direction. The golf ball holder is configured to maintain an orientation of the golf ball. The system additionally has a registration system configured to move the golf ball holder from a first position to a second position in a registration direction that is different than the travel direction.

16 Claims, 24 Drawing Sheets

GOLF BALL ALIGNMENT AND REGISTRATION IN A TRANSPORTATION SYSTEM

CROSS REFERENCE TO RELATED APPLICATIONS

The present application is a continuation-in-part of U.S. patent application Ser. No. 17/552,624, filed Dec. 16, 2021, the entire disclosure of which is hereby incorporated herein by reference.

FIELD OF THE INVENTION

This invention generally relates to a manufacturing and processing system for golf balls, and more particularly to positioning a golf ball in a transportation system.

BACKGROUND OF THE INVENTION

The manufacture of golf balls typically involves a series of sequential processes performed at different processing stations, typically spatially separated one from another. These different processing stations may require manual movement of the golf balls between different stations. For example, golf balls may need to be manually moved from a processing station to a printing area and hand-fed into a printing line. Conventional automation tools have limited applicability to golf balls, because of the wide variety of markings that are printed on golf balls, often in small quantities. Different individual printing stations may require individual preparation, planning, and turnover to produce golf balls with different printed markings, such as custom logos or other indicia. The disclosed embodiments provide automation tools for improving the processing speed and efficiency of manufacturing golf balls, especially the process of printing markings on golf balls.

SUMMARY OF THE INVENTION

According to some disclosed embodiments, the present disclosure includes a system for transporting a golf ball. The system includes at least one track. The system also includes a shuttle configured to be attached to the track for movement along the track in a travel direction. The system further includes a golf ball holder attached to the shuttle. The golf ball holder maintains an orientation of the golf ball. The system additionally includes a registration system configured to move the golf ball holder from a first position to a second position in a registration direction that is different than the travel direction.

According to some disclosed embodiments, the registration direction is perpendicular to the travel direction.

According to some disclosed embodiments, the golf ball holder includes a sliding plate configured to move in the registration direction relative to the shuttle. In some embodiments, the golf ball holder further includes at least one mounting fastener rigidly connected to the shuttle, wherein the sliding plate is configured to move in the registration direction relative to the at least one mounting fastener.

According to some disclosed embodiments, the registration system includes a push assembly configured to apply a force to the golf ball holder to move the golf ball holder from the first position to the second position. In some embodiments, the push assembly is configured to contact and push the golf ball holder.

According to some disclosed embodiments, the push assembly includes a push arm configured to move in the registration direction between a retracted position and an extended position in contact with the golf ball holder. In some embodiments, the push assembly further includes an actuator configured to move the push arm in the registration direction to thereby move the golf ball holder in the registration direction between the first position and the second position.

According to some disclosed embodiments, the golf ball holder includes a sliding plate and the push arm is configured to contact the sliding plate. In some embodiments, the push arm includes a distal end having an overhang configured to provide multi-planar contact with the sliding plate. In some embodiments, the sliding plate includes a beveled edge having a shape configured to mate with the overhang of the push arm.

According to some disclosed embodiments, the system further includes a return assembly configured to engage the golf ball holder in the second position.

According to some disclosed embodiments, the return assembly includes an interlocking feature configured to mate with a corresponding feature of the golf ball holder when the golf ball holder is in the second position. In some embodiments, the interlocking feature includes one of a pin or notch, and the golf ball holder comprises the other of the pin or notch. In some embodiments, the notch is configured to receive the pin when the golf ball holder is in the second position.

According to some disclosed embodiments, the return assembly includes a hold down configured to contact the at least one component of the golf ball holder. In some embodiments, the golf ball holder includes a sliding plate and the hold down includes a recessed surface configured to contact the sliding plate and restrain the sliding plate from rotating or lifting upward.

According to some disclosed embodiments the return assembly includes a bumper configured to urge the golf ball holder from the second position back to the first position.

According to some disclosed embodiments, the present disclosure includes another system for transporting a golf ball. The system includes at least one track. The system also includes a shuttle configured to be attached to the track for movement along the track in a travel direction. The system further includes a golf ball holder attached to the shuttle. The golf ball holder is configured to maintain an orientation of the golf ball. The golf ball holder includes a sliding plate configured to move the golf ball holder from a first position to a second position in a registration direction that is different than the travel direction. The system additionally includes a registration system positioned adjacent to the at least one track. The registration system includes a push arm on a first side of the track configured to contact a first end of the sliding plate to move the golf ball holder from the first position to the second position in the registration direction. The registration system also includes an interlocking feature on a second, opposite side of the track configured to mate with a corresponding feature on the golf ball holder when the golf ball holder is in the second position. The registration system further includes a hold down on the second side of the track configured to contact a second end of the sliding plate and restrain the sliding plate from rotating or lifting upward when the golf ball holder is in the second position.

According to some disclosed embodiments, the system also includes a printing station positioned adjacent to the at least one track. In some embodiments, the printing station includes at least one printing pad configured to print on a golf ball held by the golf ball holder when the golf ball holder is in the second position.

DETAILED DESCRIPTION OF THE INVENTION

According to disclosed embodiments, a high-speed golf ball handling and management system is disclosed for golf ball manufacturing, and, more particularly, golf ball orientation, printing, offloading, and packaging. The disclosed embodiments include a transportation system for moving a plurality of golf balls through one or more processing stations via an interconnected track system. A control system is connected with the track system and various stations to control the movement of golf-ball-transporting shuttles within the handling and management system. The shuttles may be configured to switch between the plurality of tracks based on instructions from the control system. The golf ball handling and management system includes at least one processing station, such as a printing station, that performs a manufacturing or processing task related to the golf ball.

In at least some embodiments, the control system is configured to manage a plurality of simultaneous tasks within the handling and management system. For example, the control system may be configured to control a first shuttle to arrive at a first processing station for a first processing task while simultaneously controlling a second shuttle to arrive at a second processing station for a second task. In an exemplary embodiment, the control system is configured to generate a processing plan for a golf ball and/or lot of golf balls received at an onboarding station and thereafter control the movement of multiple shuttles simultaneously to increase the throughput of the system. For example, the control system may simultaneously control different printing processes for different golf ball lots and deliver the golf balls to a packaging station for grouping and packaging of similar lots.

Further embodiments may include particularized tools and equipment for processing golf balls using the disclosed transportation system. For example, some embodiments include a golf ball holder configured to mount to a shuttle that is transported by the disclosed transportation system. The holder may include features to hold and maintain a golf ball in a desired orientation on a shuttle such that when the shuttle is delivered to a processing station, the golf ball can be processed with precision and reliability. For example, the holder may be configured to orient a golf ball to expose a portion of the golf ball for printing on the golf ball. The holder may further include features for interacting with a processing station, such as a printing station. Similarly, the processing station may include particularized features for interacting with the holder and/or shuttle.

Figure 1A:
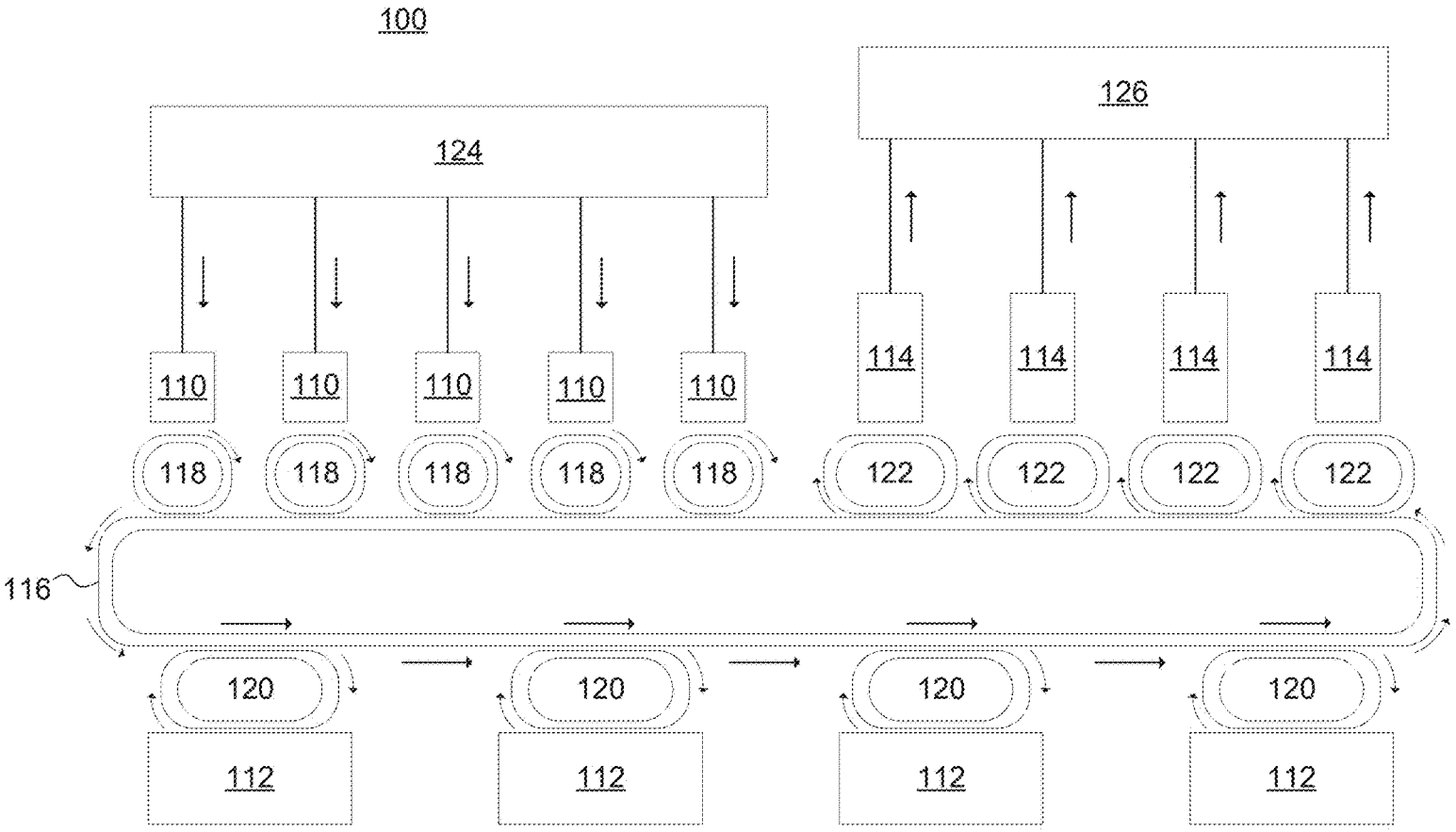
FIG. 1A is a diagram of an exemplary golf ball transportation system, consistent with disclosed embodiments.

FIG. 1A is a diagram of a golf ball transportation system 100. The system 100 is configured to transport a plurality of golf balls between a plurality of processing and/or manufacturing stations 110, 112, and 114. The plurality of stations 110, 112, and 114 are connected by primary track 116 and a plurality of station tracks 118, 120, and 122. In an exemplary embodiment, each station track 118, 120, and 122 is associated with a station 110, 112, or 114. The primary track 116 connects each of the station tracks 118, 120, 122 to each other. Each of the primary track 116 and station tracks 118, 120, 122 may be a continuous loop, but are not limited thereto. It should be understood that, as shown in the drawing, each station 110, 112, 114 may be a station grouping of a plurality of stations. For example, the stations 110 may be a group of orienting stations for each onboarding and orienting a golf ball in the system 100. The use of multiple stations in a group may add to the output and efficiency of the system 100. Similarly, each station track 118, 120, 122 may be a station track grouping of a plurality of station tracks as shown. Further, it should be understood that the illustrated configuration is merely one example and that other embodiments may include a different configuration of stations and tracks.

In an exemplary embodiment, the system 100 is configured to receive a plurality of golf balls from a golf ball delivery system 124, transport the plurality of golf balls between stations 110, 112, and 114, and output the processed golf balls though a golf ball output system 126. Within the system 100, the golf balls may move between stations 110, 112, and 114 via connections from the primary track 116. For example, a golf ball may be input at the golf ball delivery system 124, placed onto station track 118 via the station 110, transfer to the primary track 116 where it is delivered to station track 120 for processing at station 112, and transferred back to the primary track 116 before it is delivered to station track 122 for removal via station 114. In some embodiments, the golf ball is transferred to multiple stations 112 before transfer to a station track 122.

As shown in FIG. 1A, the station tracks 118, 120, and 122 have a loop configuration such that a golf ball can be transferred to the track, processed at corresponding station equipment, and looped back onto the primary track 116. Further, the station tracks 118, 120, and 122 do not physically contact the primary track 116. The transportation system 100 may be configured with equipment for inducing motion to the golf balls. The equipment may include, for example, a stator motor system such as a linear track system produced by B&R Industrial Automation GmbH and/or as described in any of U.S. Pat. Nos. 10,118,775, 10,532,891, 10,913,362, and 11,161,700, which are hereby incorporated by reference in their entirety. Other similar transportation systems may also be applicable for high-speed transportation of golf balls on a plurality of tracks.

Figure 1B:
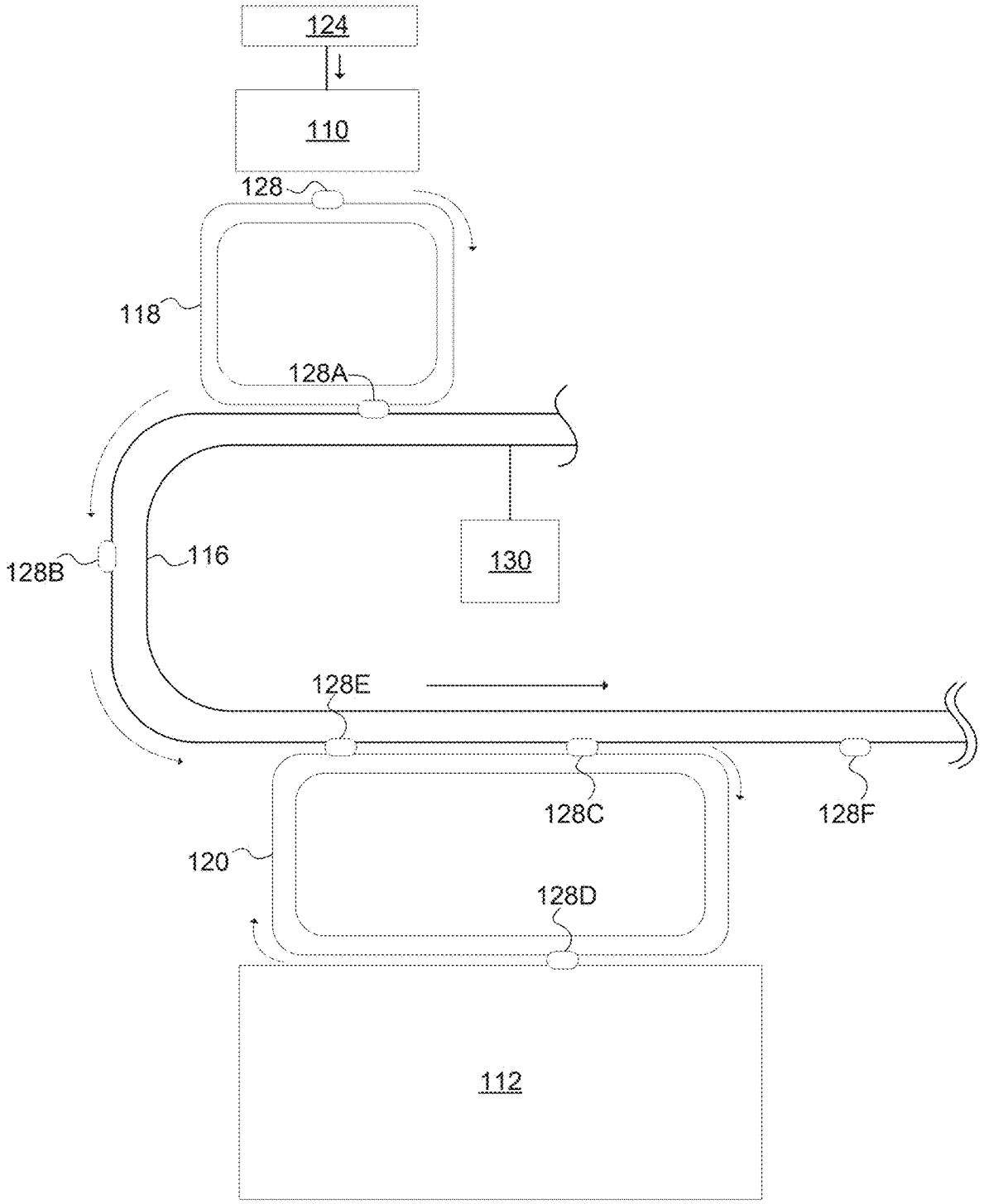
FIG. 1B is another diagram of a portion of the golf ball transportation system of FIG. 1A, further depicting movement of golf ball shuttles through the system, consistent with disclosed embodiments.

FIG. 1B further illustrates a selected portion of the system 100, including the station 110 and station 112 connected by a portion of the primary track 116 and station tracks 118 and 120. In an exemplary embodiment, the system 100 further includes at least one shuttle 128. Each shuttle 128 is configured to move along the primary track 116 and each of the station tracks 118, 120, and 122. Each shuttle 128 is configured to carry at least one golf ball thereon. An exemplary embodiments of the shuttle 128 is shown and described in relation to FIGS. 5 and 6. In some embodiments, the station 110 is configured to place and orient a golf ball on a shuttle 128. In some embodiments, a control system 130 is configured to use software and power controls to selectively move the shuttle 128 (and the golf ball(s) carried thereon) throughout the system 100. The control system 130 may be, for example, a computing device having at least a processing unit and a memory storing instructions for the processing unit to execute to complete one or more processes. The control system 130 may be configured to send signals to components of the system 100 to control movement of the shuttles 128 in the system. As described, the primary track 116 does not physically contact any of the station tracks 118, 120, 122. This enables high-speed track switching by the shuttles 128, which have multiple bearing surfaces for riding on the different tracks in the system.

FIG. 1B further depicts exemplary movement of the shuttle 128 through the system 100. The shuttle 128 may start adjacent to the station 110, which may be an onboarding and/or orienting station. The station 110 may include equipment for placing a golf ball on the shuttle 128. For example, the station 110 may place the golf ball on the shuttle 128 in a selected orientation. The shuttle 128 moves around the station track 118 to the position shown at 128A, where the shuttle 128 is transferred from the station track 118 to the primary track 116. The shuttle continues along the primary track to the position shown at 128B and eventually to the position at 128C where it is transferred to the station track 120. The shuttle 128 moves around the station track 120 and is positioned at 128D for processing at the station 112 (e.g., pad printing). The shuttle 128 continues along the loop of the station track 120 until it is transferred back to the primary track 116 at the position shown at 128E. The shuttle 128 continues along the primary track 116 to the position at 128F and continues on to another processing station and/or for eventual removal of the golf ball from the system 100 by an offloading station. As shown, the positions at 128A, 128C, and 128E are transfer positions in which the shuttle 128 comes into proximity with the primary track 116 and one of the station tracks 118, 120, 122, even though the tracks do not physically contact each other. The system 100 is thus configured to enable the shuttles 128 to perform high-speed and seamless switching between tracks according to instructions from the control system 130.

In an exemplary embodiment, the system 100 is an automated system for printing markings on a golf ball. In an exemplary embodiment, the station 110 is an orienting station configured to onboard and position a golf ball in a particular orientation on a shuttle 128. Each station 112 may be a printing station configured to print a marking on the golf ball carried by the shuttle 128. Each station 114 may be an offloading station configured to receive a golf ball after it has been stamped and deliver the golf ball for further processing (e.g., packaging). The golf ball delivery system 124 may be configured to deliver a plurality of golf balls to the orienting stations 110 and the offloading stations 114 may be configured to deliver the printed golf balls to the golf ball output system 126 for packaging or other processing steps. The control system 130 may be configured for high speed movement of a plurality of golf balls throughout the system 100 simultaneously. The control system 130 may be programmed with anti-collision software to ensure that a plurality of shuttles 128 can move through the system 100 smoothly and without collisions or interruptions. As a result, the system 100 is configured as a high-speed, high-throughput system for printing markings on golf balls prior to packaging and/or delivery of a final product. For example, the system 100 may achieve a processing speed of 300 balls per minute (300 printed golf balls being offloaded every minute). It should be understood, however, that printing is one example of a processing step that may be accomplished using the system 100. The system 100 may be modified and/or adapted to accomplish other golf ball and/or golf equipment processing steps in a high-speed and high-precision production line.

Figure 2:
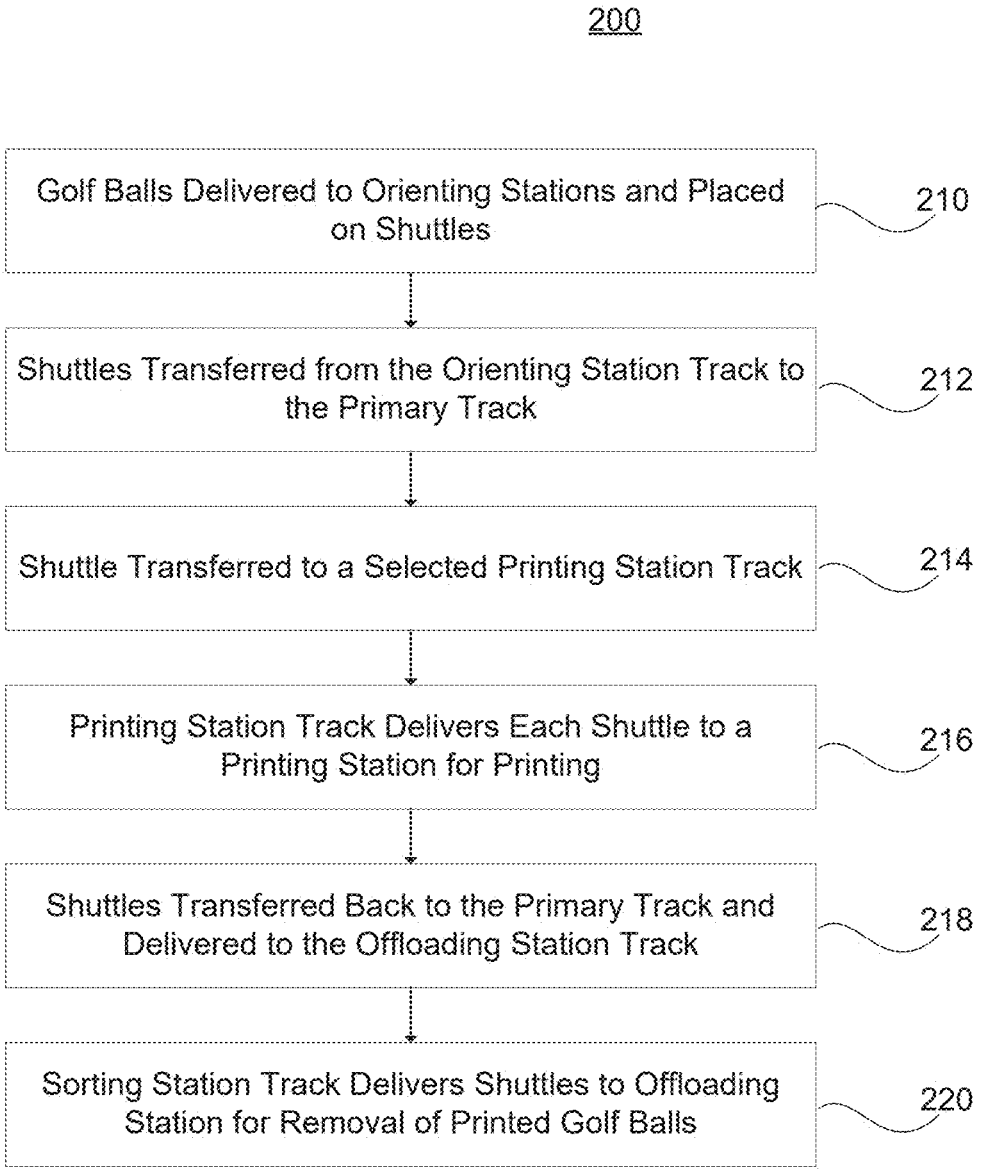
FIG. 2 is a flowchart of an exemplary process for processing a golf ball using the transportation system of FIG. 1A.

FIG. 2 is a flowchart of an exemplary golf ball manufacturing process 200. The process 200 may be performed by one or more components of the system 100, such as via control system 130 executing software instructions to move golf balls on shuttles 128. In step 210, a plurality of golf balls are delivered to orienting stations 110 by the golf ball delivery system 124. The orienting stations 110 may be configured to individually place a golf ball onto a shuttle 128 in a desired orientation. The desired orientation may be a positioning of the golf ball such that printing will occur at a selected location on the golf ball. The orienting station 110 may, for example, inspect a golf ball for a dimple pattern or other distinguishing characteristic (e.g., existing printed markings such as logos, side stamps, alignment markings, etc.) in order to orient the golf ball. In an exemplary embodiment, the golf ball delivery system 124 may be a complex sorting system configured to deliver different types of golf balls to the system 100 and may provide processing orders to the control system 130 for controlling the golf balls through the system 100 and applying the appropriate steps (e.g., printing a desired marking on a particular ball and further sorting that golf ball to a desired destination).

In step 212, the shuttle 128 is moved along the station track 118 and transferred to the primary track 116. For example, the shuttle 128 may be configured to ride along a side of the station track 118 and switch to the primary track 116 via electromagnetic force attracting the opposite side of the shuttle 128 to the side of the primary track 116. The control system 130 may be configured to continuously store a location of the shuttle 128 and move the shuttle 128 along the primary track 116 to a next destination according to a desired manufacturing process.

Figure 3:
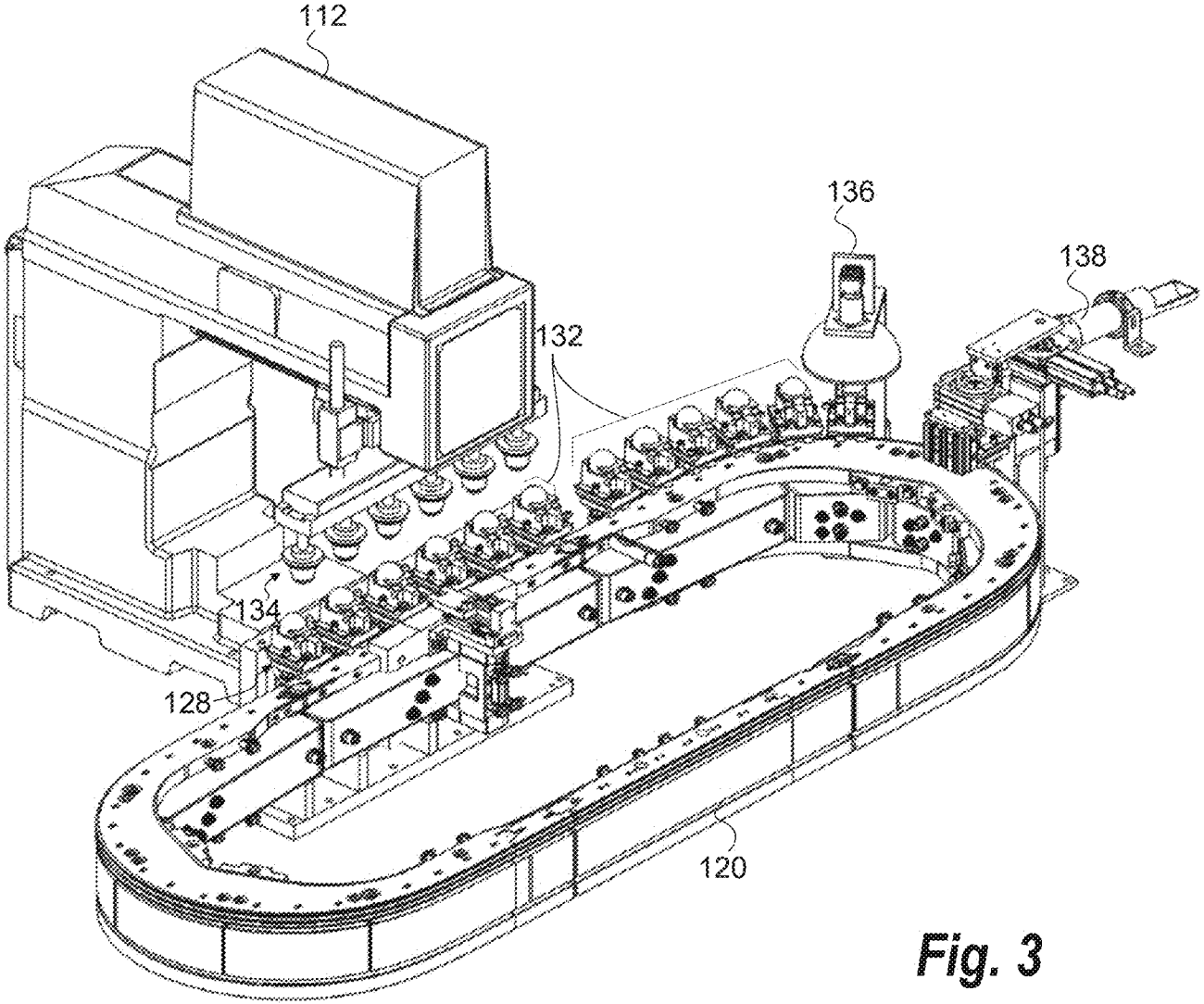
FIG. 3 is a perspective view of an exemplary printing station and associated station track, consistent with disclosed embodiments.

In step 214, the control system 130 instructs the system 100 to transfer the shuttle 128 to the station track 120. In step 216, the station track 120 delivers the shuttle 128 to the printing station 112 for printing on the oriented golf ball. The printing station 112 is not limited to any particular printing process and can include multiple steps for printing. For example, the printing station 112 may be configured with multiple printing and orienting steps for complex printing on the golf ball. FIG. 3 depicts an exemplary embodiment of a printing station 112 and a station track 120. A plurality of shuttles 128 are configured to move along a side of the station track 120 to deliver a plurality of golf balls 132. The printing station 112 includes a printing apparatus 134, such as a plurality of printing pads configured to stamp markings on a golf balls 132. The system 100 may be configured such that the golf balls 132 are stopped in position under the printing apparatus 134 for printing before continuing along the station track 120. The printing station 112 may include, in some embodiments, an inspection station 136 for inspecting a printed marking and a removal device 138 (e.g., kickout) for selectively removing any golf balls that do not pass a visual inspection test. In some embodiments, the printing station 112 may further include a curing apparatus for drying the printed ink.

Returning to FIG. 2, in step 218, the shuttle 128 is returned to the primary track 116 and delivered to the offloading station 114 via the station track 122. For example, after the printing steps are completed via one or more printing stations 112, the golf ball may be satisfactory for offloading and/or packaging. In step 220, the offloading station 114 may remove a printed golf ball from the system 100. For example, the offloading station 114 may place a printed golf ball in a particular packaging system or location based on instructions from the control system 130.

The process 200 is an example method for processing a golf ball such that a particular type of golf ball is selected, delivered to a printing station in a desired orientation, printed according to desired specifications, and delivered to a target destination for packaging or further processing. The system 100 is configured such that this process may be continuously repeated and run simultaneously with many golf balls, even if the golf balls have different processing plans (e.g., different printing). As a result, a high-speed, high-throughput golf ball printing line may be realized.

Figure 4:
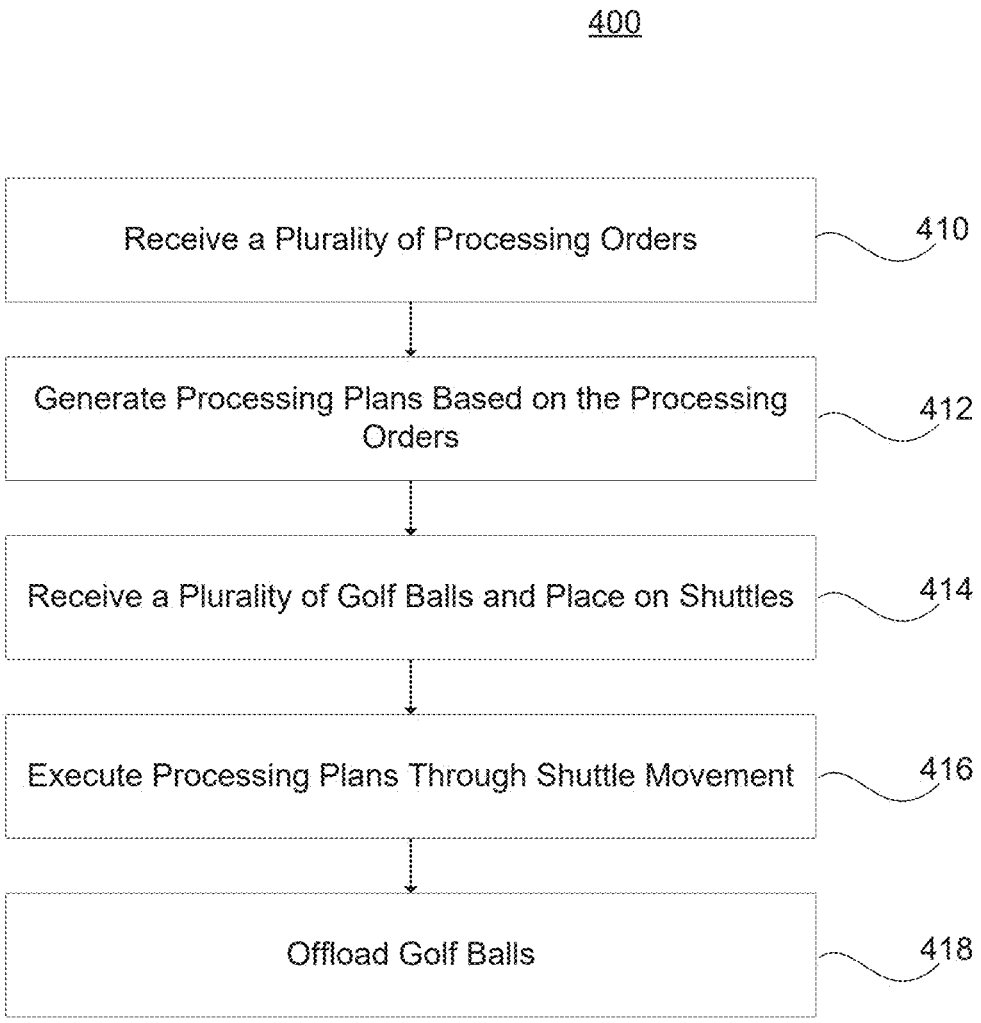
FIG. 4 is a flowchart of an exemplary process for simultaneously processing a plurality of golf balls using the transportation system of FIG. 1A.

FIG. 4 is a flowchart of an exemplary process 400 for processing multiple golf balls simultaneously in the system 100. In an exemplary embodiment, the control system 130 may be configured to provide instructions to one or more components of the system 100 to perform the steps of the process 400. For example, the control system 130 may be connected to one or more motors, controllers, switches, power sources, and the like, to control the movement of the plurality of shuttles 128 within the system 100.

In step 410, the control system 130 may receive a plurality of processing orders. Each processing order may include instructions for performing a manufacturing task on at least one golf ball. For example, a first processing order may include instructions for printing a first marking on one dozen golf balls. Another example may include a processing order for printing a second marking on another dozen golf balls. The processing order may include information identifying the station and/or stations 112 within the system 100 to perform the manufacturing task (e.g., which station or stations is prepared to print a desired marking).

In step 420, the control system 130 may generate processing plans based on the processing orders. For example, the control system 130 may convert the processing plans into concrete instructions for accomplishing the desired manufacturing task. In one example, the control system 130 may select a station 110 to identify and place the golf ball on a shuttle 128. The control system 130 may also select at least one station 112 to complete at least one processing step (e.g., printing, orienting, curing, painting, etc.). In some embodiments, the control system 130 may select multiple stations 112 to perform processing steps (e.g., printing at two different printing stations). The control system 130 may also select a station 114 to offload the golf ball.

In step 430, the system 100 may receive a plurality of golf balls from the golf ball delivery system 124. In some embodiments, the control system 130 may control the golf ball delivery system 124 to deliver a particular type of golf ball to a selected one of the stations 110. In step 440, the control system 130 is configured to control the system 100 to execute the processing plans on the onboarded golf balls through movement of the shuttles 128. In step 450, the finished golf balls are offloaded form the system 100 based on instructions from the control system 130.

According to some embodiments, the disclosed system 100 is applicable to quickly and efficiently process a plurality of golf balls simultaneously. The control system 130 is configured to generate processing plans and orchestrate timing of the movement of multiple shuttles 128 such that golf balls associated with different manufacturing tasks may be intermixed without losing track of processing orders. For example, a first, third, fifth, etc. golf ball through the system 100 may be oriented at a first station 110, printed at a first station 112, and offloaded a first station 114. A second, fourth, sixth, etc., golf ball through the system may be oriented at a second station 110, printed at a second station 112, and offloaded at a second station 114. The throughput/capacity of the system 100 can thus be customized based on the number of stations and tracks placed into the system and the complexity of the manufacturing tasks to be completed.

In another example, a golf ball of a first type may be delivered to a printing station for printing of a first marking while a golf ball of a second type may be delivered to the same or a different printing station for printing of a different second marking. The differently-printed golf balls may be delivered to different offloading stations and/or sorted into different packaging locations for packaging of similar golf balls. For example, one golf ball may receive a single printing stamp at one printing station, a second golf ball may receive multiple printing stamps at the same printing station, and another golf ball may receive multiple printing stamps at different printing stations within the transportation system. In this way, multiple different golf ball lots with different parameters may be processed simultaneously without collision or interruptions. The control system 130 may associate processing steps with a particular shuttle and provide instructions to track that shuttle throughout the transportation system for accurate final delivery and/or packaging.

The disclosed embodiments further include equipment, tools, adapters, etc. configured to enable the shuttles 128 to particularly carry a golf ball and, further, for the motion components to interact with the processing stations, such as a printing station.

Figure 6:
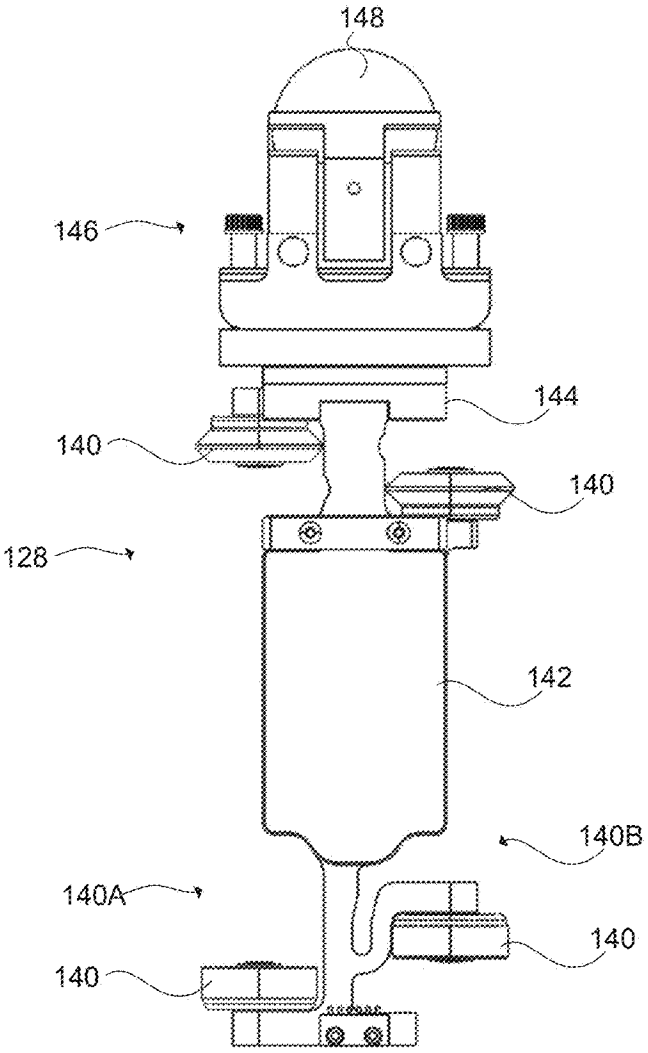
FIG. 6 is a front view of the shuttle of FIG. 5, consistent with disclosed embodiments.
Figure 5:
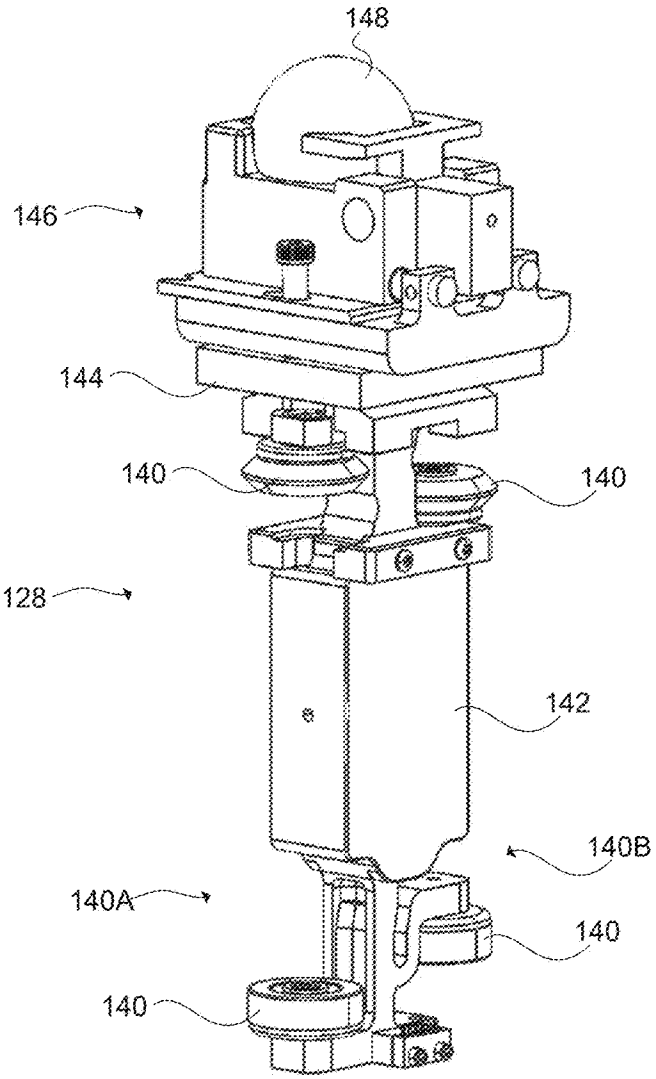
FIG. 5 is a perspective view of an exemplary shuttle configured to carry a golf ball through the transportation system of FIG. 1A, consistent with disclosed embodiments.
Figure 8:
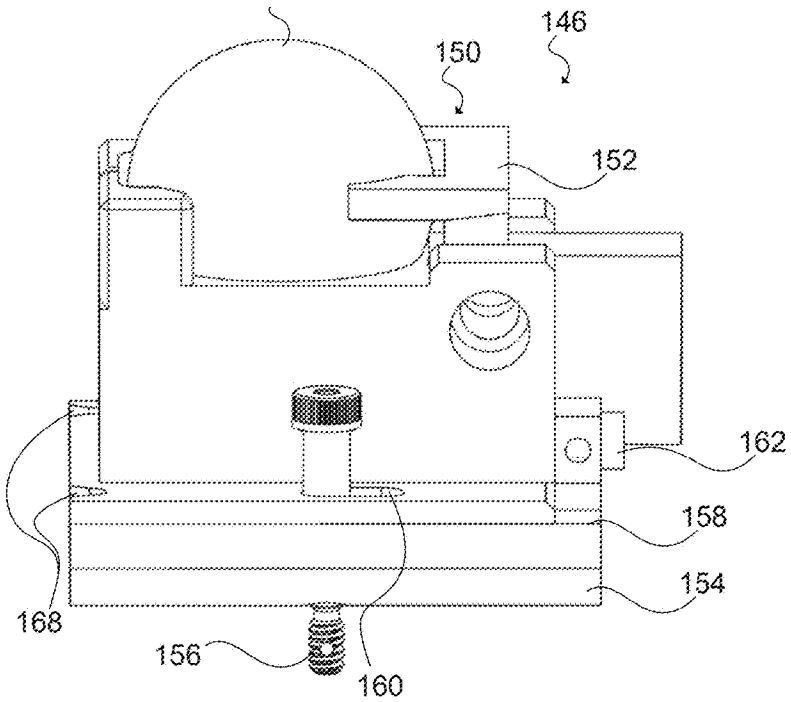
FIG. 8 is another perspective view of the golf ball holder of FIG. 7, consistent with disclosed embodiments.
Figure 7:
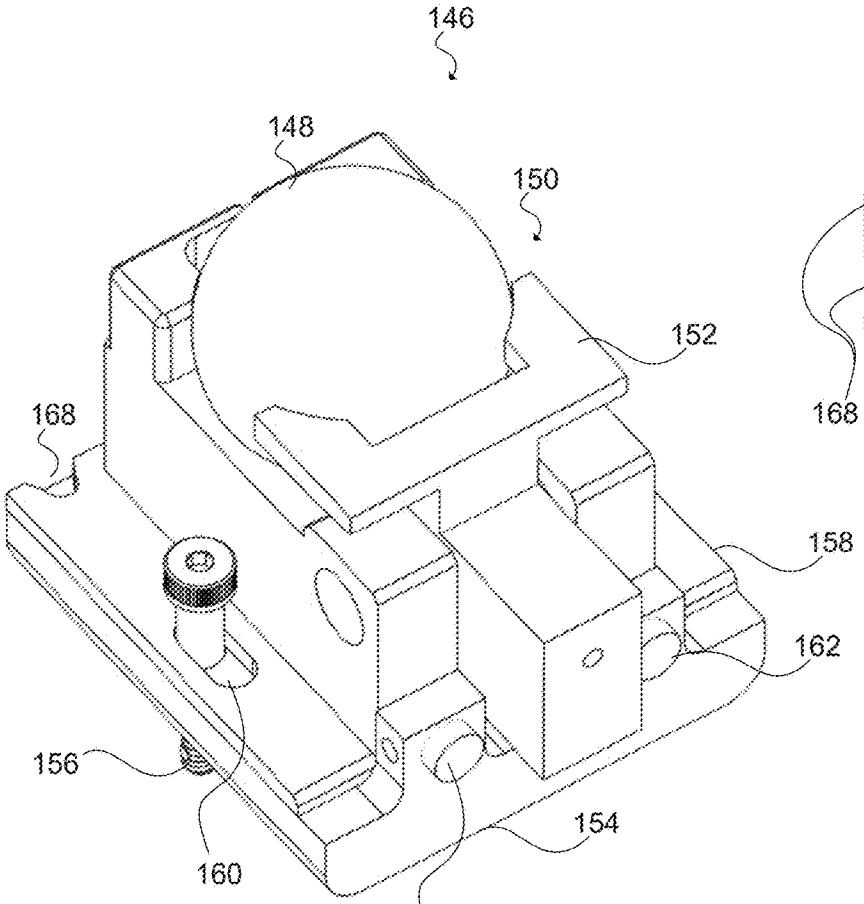
FIG. 7 is a perspective view of a golf ball holder for positioning a golf ball on a shuttle, including a lock mechanism in an open position, consistent with disclosed embodiments.
Figure 10:
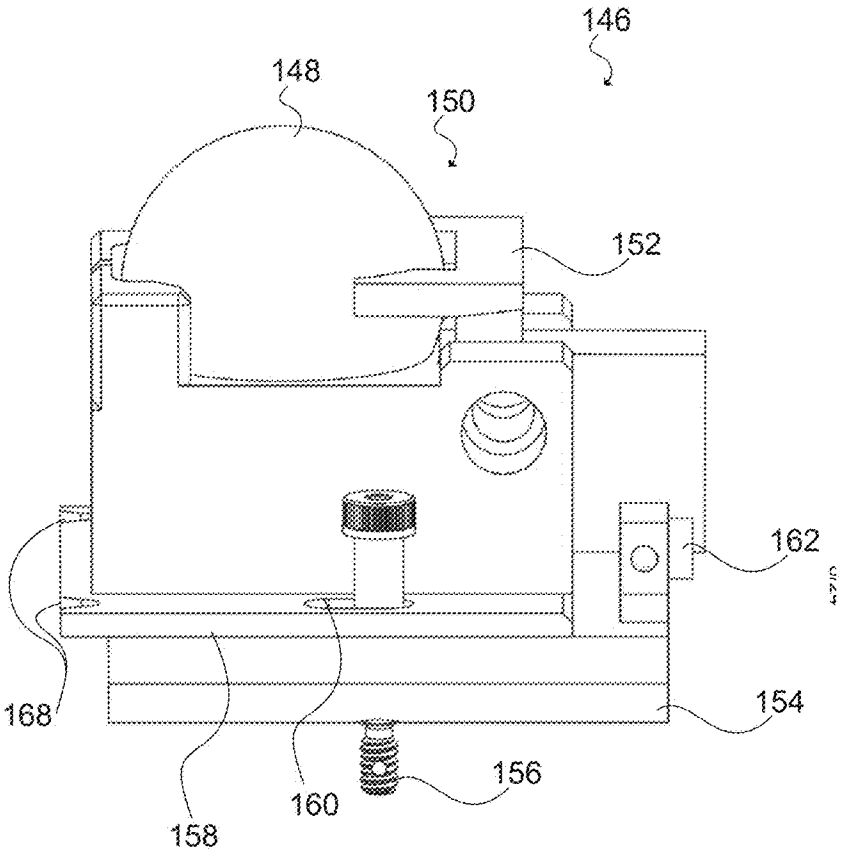
FIG. 10 is another perspective view of the golf ball holder of FIG. 7 in the locked position, consistent with disclosed embodiments.
Figure 9:
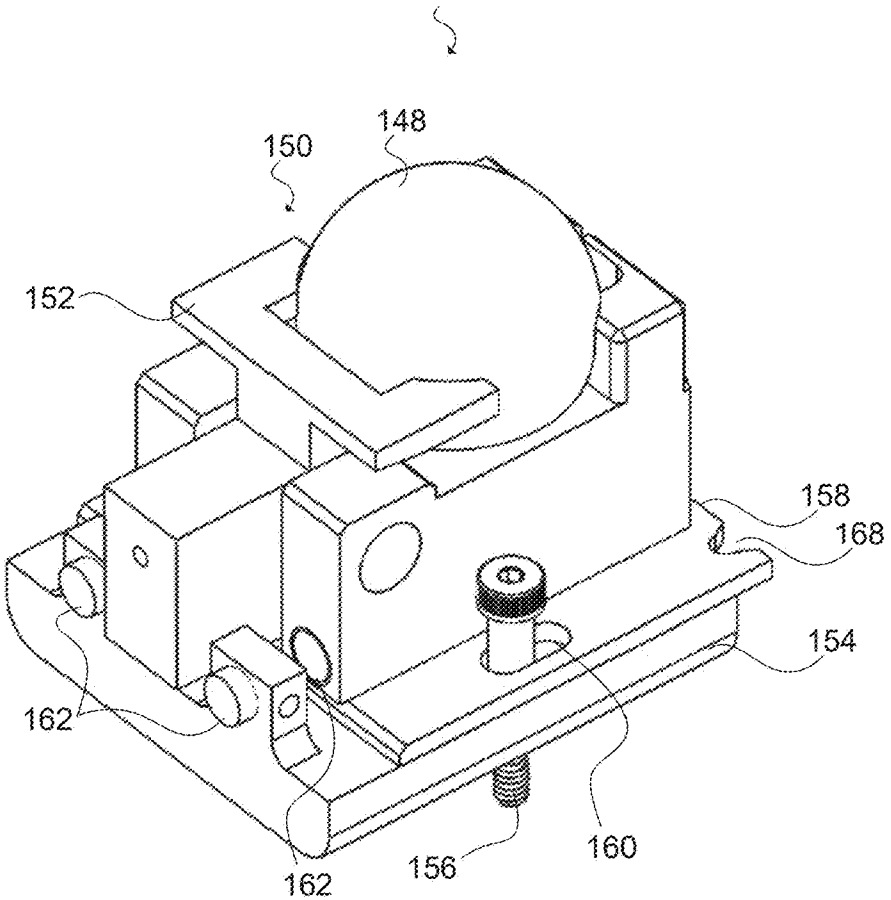
FIG. 9 is another perspective view of the golf ball holder of FIG. 7, including the lock mechanism in a locked position, consistent with disclosed embodiments.

FIGS. 5 and 6 include a perspective and side view of an exemplary shuttle 128 that may be used in conjunction with the transportation system 100 described herein. The shuttle 128 may include bearings 140 configured to enable movement of the shuttle 128 on the side of the primary track 116. The shuttle 128 may particularly include bearings 140 on two sides of a stanchion 142 to enable transfer of the shuttle 128 from one track to another (e.g., the shuttle 128 may ride on one side of a track and transfer to an adjacent track that comes in proximity to an opposite side of the shuttle). For example, the shuttle 128 may include a first side bearing 140A and a second side bearing 140B on opposing sides. The first side bearing 140A may be configured to ride the primary track 116 and the second side bearing 140B may be configured to ride on the plurality of station tracks 118, 120, 122. In this way, each shuttle 128 may be configured to switch between the primary track 116 and the station tracks 118, 120, 122 at high speeds even though the primary track is physically spaced from the station tracks 118, 120, 122. As the shuttle 128 arrives at positions in which the shuttle 128 is in proximity to both the primary track 116 and a respective one of the station tracks 118, 120, 122, the control system 130 can use a force (e.g., electromagnetic switch) to transfer the shuttle between the tracks. The shuttle 128 may further include a mount 144 attached to the stanchion 142 and configured to support a golf ball holder 146. The golf ball holder 146 is configured to receive and hold a golf ball 148 on the shuttle 128 such that the golf ball 148 can be moved through the transportation system 100.

FIGS. 7-10 further illustrate an exemplary embodiment of the golf ball holder 146. The golf ball holder 146 includes a holding clamp 150 for receiving and holding the golf ball 148 in place. The holding clamp 150 comprises a movable contact element 152 that is configured to move between a first position in which the golf ball 148 can be placed into the holding clamp 150 and a second position that contacts the golf ball 148 and inhibits movement of the golf ball 148. For example, the movable contact element 152 may be connected to another portion of the holding clamp 150 by a hinge.

The golf ball holder 146 further includes a mounting plate 154 configured to attach to the mount 144 of the shuttle 128 via one or more mounting pins 156. The mounting pins 156 may be fixed to the mount 144 but movable relative to the mounting plate 154 in a vertical direction. For example, the mounting plate 154 may be configured to move upward such that the golf ball holder is spaced vertically from the mount 144. The mounting pins 156 may include enlarged heads to inhibit complete removal of the golf ball holder 146.

In addition to the golf ball holder 146 being movable in a vertical direction relative to the mount 144, the holding clamp 150 is also relatively movable in a horizontal direction relative to the mounting plate 154 and mount 144 through attachment of a sliding plate 158. The sliding plate 158 includes at least one slot 160 configured to receive a portion of the mounting pin 156 and thereby enables the sliding plate 158, holding clamp 150, and golf ball 148 to move in a horizontal direction relative to the mounting plate 154 and underlying shuttle 128. The size of the slot 160 may determine a range of horizontal movement of the holding clamp 150.

The relative movement of the holding clamp 150 helps to enable proper positioning and registration of the golf ball 148 with respect to a processing station. For example, the golf ball holder 146 may be configured for vertical linear movement to enable the mounting plate 154 to rest on a support surface during a printing operation. In another example, the golf ball holder 146 may be configured for horizontal linear movement between an open position depicted in FIGS. 7 and 8 and a locked position depicted in FIGS. 9 and 10. In an exemplary embodiment, the golf ball holder 146 may be biased into the open position by a corresponding magnets 162 on the holding clamp 150 and the mounting plate 154. The golf ball holder 146 may be selectively movable into the locked position through application of a linear force on the holding clamp 150 and/or the sliding plate 158. For example, a sufficient linear force may be applied to break the attraction of the magnets 162 to move the golf ball holder 146 into a locked position. When the sufficient linear force is removed, the magnets 162 may return the golf ball holder 146 into the open position.

The vertically-movable mounting plate 154 and horizontally-movable sliding plate 158 may enable the golf ball holder 146 to move into a registration position during a manufacturing process. For example, the golf ball holder 146 may be moved vertically onto a support surface to remove load from the underlying shuttle 128 and also moved into the locked position to place the golf ball into a position directly under a printing pad of a printing station.

Figure 11:
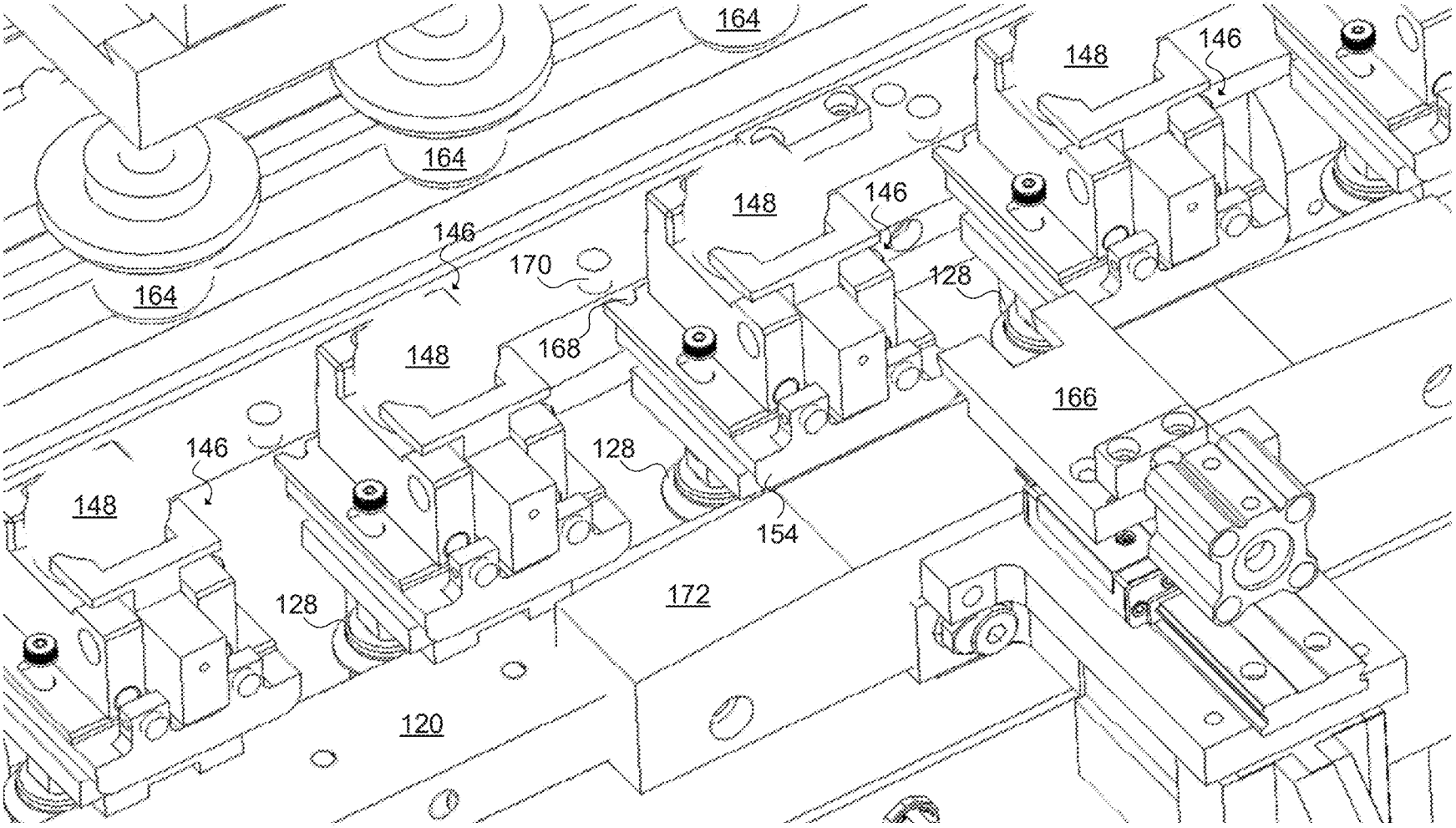
FIG. 11 is a close-up view of a portion of the printing station of FIG. 3, including a plurality of shuttles and golf ball holders being carried by the associated track, consistent with disclosed embodiments.

FIG. 11 is a close-up view of a plurality of golf ball holders 146 carried on corresponding shuttles 128 on a station track 120. The printing station 112 includes a plurality of printing pads 164 for printing on the golf balls 148 held by the golf ball holders 146. The printing station 112 may further include at least one push block 166 that is controllable (e.g., by the control system 130) to apply a linear force to push the golf ball holder 146 into the locked position (e.g., by sliding the sliding plate 158 forward and moving mounting pins 156 within the slots 160. The sliding plate 158 may further comprise one or more notches 168 configured to move and receive a corresponding stationary pin 170 on the printing station 112 to thereby lock the golf ball holder 146 into position with respect to the printing station 112 for precise and reliable printing by the printing pad 164. While only one is depicted, a plurality of adjacent push blocks 166 (e.g., one for each printing pad 164) may be provided to selectively lock a plurality of golf ball holders 146 in a printing position for simultaneous printing of on more than one golf ball 148.

The printing station 112 may also include a support rail 172 attached to the station track 120. The support rail 172 is raised relative to the station track 120 such that during movement of the shuttles 128 on the station track 120, each mounting plate 154 is configured to ride up onto the support rail 172, thereby moving the golf ball holder 146 upward with respect to the shuttle 128. The support rail 172 thereby provides support to the golf ball holder 146 such that a downward force onto the golf ball 148 (e.g., via the printing pads 164) is absorbed by the support rail 172. The support rail 172 may be sized to correspond to a single printing pad 164 or be extended under a plurality of printing pads 164. The support rail 172 thus helps to inhibit damage to the shuttles 128 that may otherwise be caused by the downward force of the printing pads 164.

The disclosed golf ball holder 146 may be considered an adapter for enabling a shuttle 128 to receive and hold a golf ball 148. The shuttle 128 is thus not limited to the embodiments shown and could include additional or alternative features for transporting a golf ball holder 146 on a track. While the golf ball holder 146 has been described in relation to a printing station 112, it should be understood that the disclosed embodiments are not limited to any particular manufacturing operation. For example, instead of pad printing, a station track may move a shuttle and golf ball holder into position for another golf ball manufacturing step, such as applying a spray paint or coating layer to an in-process golf ball. Such a golf ball holder may include similar features for enabling movement (i.e., locking) relative to the shuttle to position the golf ball with respect to the processing equipment.

Figure 12:
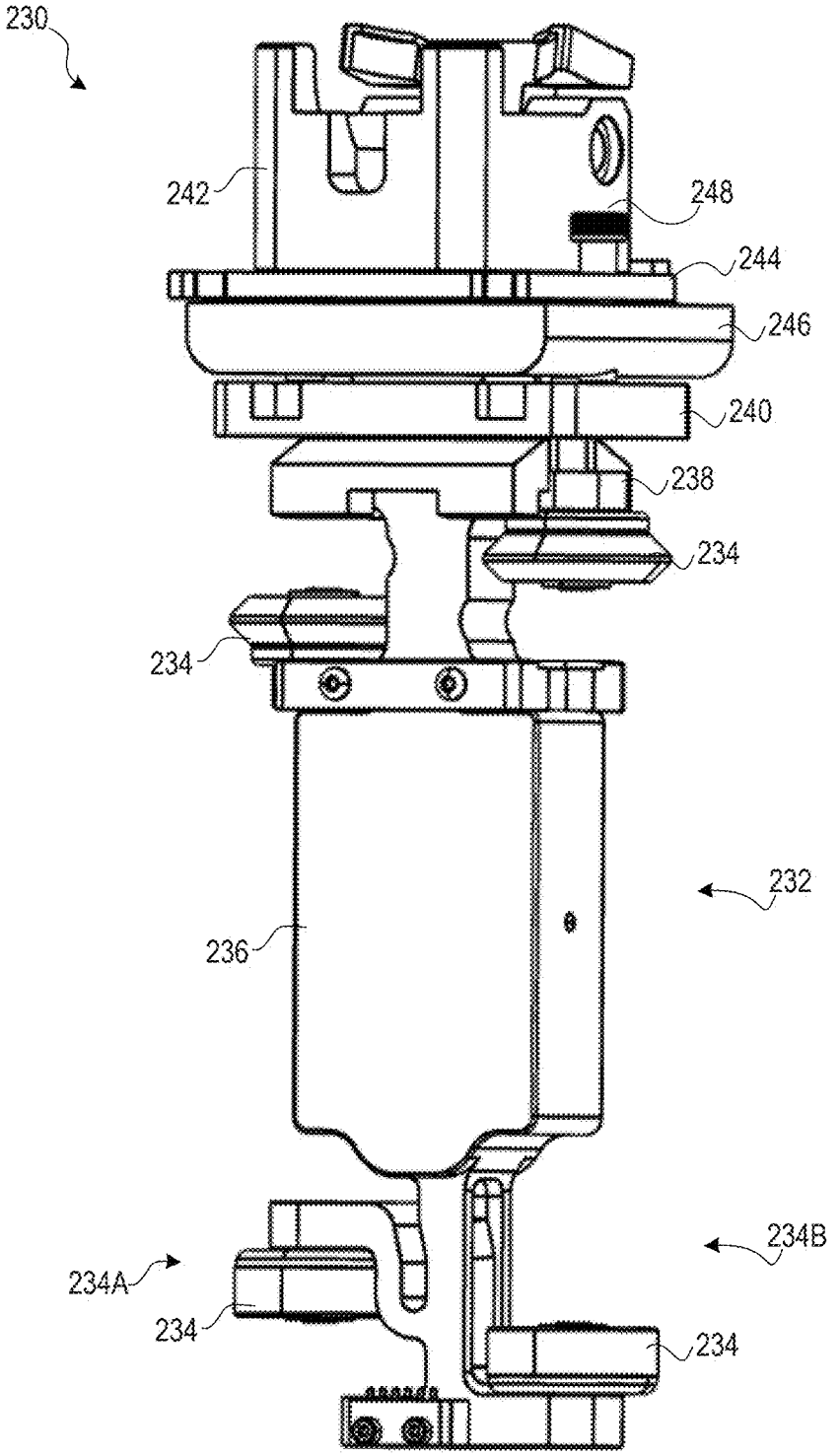
FIG. 12 is a perspective view of a golf ball holder on a shuttle, according to another embodiment.

FIGS. 12-17 depict another embodiment of a golf ball holder 230 mounted to a shuttle 232. FIG. 12 is a perspective view of the golf ball holder 230 and shuttle 232. The shuttle 232 may be used in conjunction with the transportation system 100 described herein. The shuttle 232 may be the same as or similar to the shuttle 128 described in relation to FIGS. 5 and 6. For example, the shuttle 232 may include bearings 234 configured to enable movement of the shuttle 232 on the side of a track (e.g., the primary track 116). The shuttle 232 may particularly include bearings 234 on two sides of a stanchion 236 to enable transfer of the shuttle 232 from one track to another. For example, the shuttle 128 may include a first side bearing 234A and a second side bearing 234B on opposing sides. The first side bearing 234A may be configured to ride the primary track 116 and the second side bearing 234B may be configured to ride on the plurality of station tracks 118, 120, 122. The shuttle 232 may further include an attachment member 238 attached to the stanchion 236 and configured to support the golf ball holder 230. A mount 240 is positioned between the golf ball holder 230 and the attachment member 238 to connect the golf ball holder 230 to the shuttle 232. The mount 240 may be considered part of the golf ball holder 230 or the shuttle 232.

Figure 13:
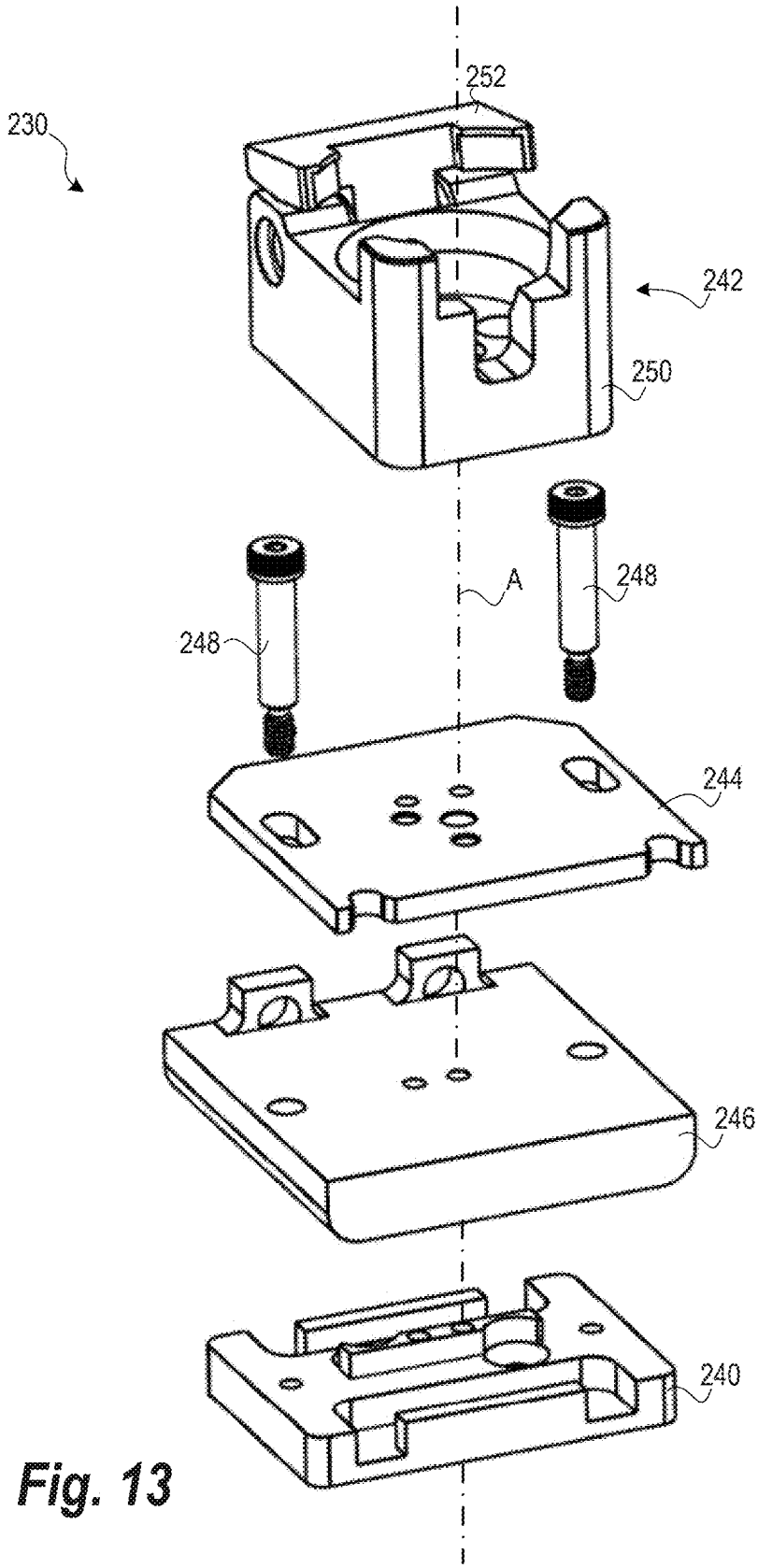
FIG. 13 is an exploded view of the golf ball holder of FIG. 12, consistent with the disclosed embodiments.

FIG. 13 shows an exploded view of the golf ball holder 230. The golf ball holder 230 includes a holding clamp 242, a sliding plate 244, a mounting plate 246, and a pair of mounting pins 248. The holding clamp 242 is configured to be rigidly attached to the sliding plate 244 (e.g., via bolts/screws). In some embodiments, the holding clamp 242 and sliding plate 244 may be integrally formed as one piece (a holding clamp having integral elements of the disclosed sliding plate). The mounting pins 248 are configured to pass through the sliding plate 244 and the mounting plate 246 and rigidly attach to the mount 240. The mounting pins 248 may be precision dowel pins. In other embodiments, other mounting fasteners may be used in place of or in addition to pins. As shown in FIGS. 12 and 13, the components of the golf ball holder 230 and the shuttle 232 are arranged such that they are generally stacked along a vertical axis A. In an exemplary embodiment, the mounting pins 248 extend longitudinally in a direction along and/or parallel to the vertical axis A.

Figure 14:
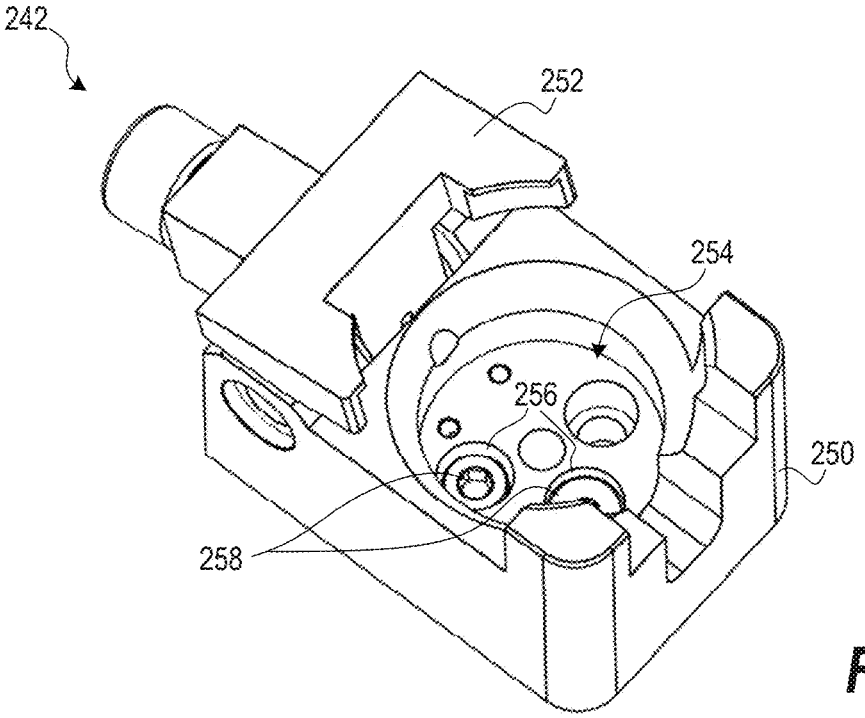
FIG. 14 is a top perspective view of a holding clamp, consistent with disclosed embodiments.

FIG. 14 further illustrates the holding clamp 242. The holding clamp 242 includes a cup 250 and a movable contact element 252. The cup 250 may be a cradle or other shape having a configuration for supporting a golf ball. The movable contact element 252 is configured to move into and out of contact with a golf ball in the cup 250 in order to hold the golf ball in place. For example, the movable contact element 252 may lock a golf ball in place so that it does not move relative to the cup 250 during a printing operation. In an exemplary embodiment, the cup 250 includes a cavity 254 for receiving at least a portion of the golf ball. The holding clamp 242 may include one or more mounting holes 256 for receiving fasteners 258 for rigid attachment to the sliding plate 244.

Figure 15:
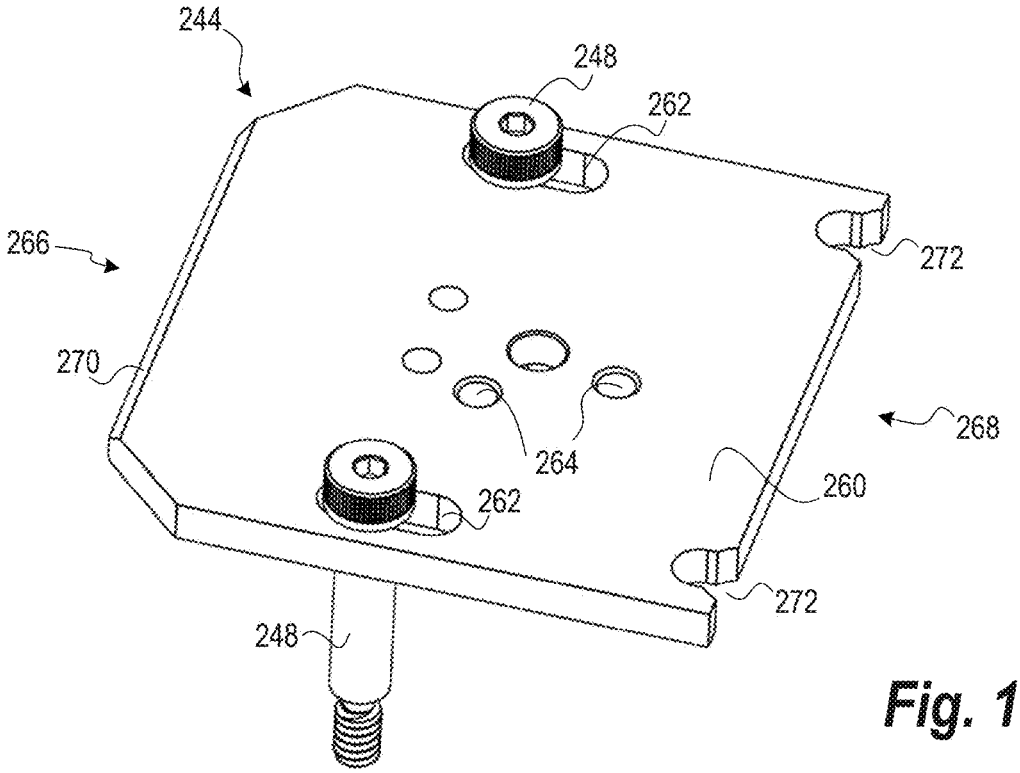
FIG. 15 is a top perspective view of a sliding plate, consistent with disclosed embodiments.

FIG. 15 further illustrates the sliding plate 244 and the mounting pins 248, according to an embodiment. The sliding plate 244 includes a top surface 260 and an opposite bottom surface (not shown). The top surface 260 and the bottom surface may be flat surfaces. The holding clamp 242 is configured to rest on the top surface 260. The sliding plate 244 further includes at least one slot 262. The slots 262 are configured to receive the mounting pins 248. The sliding plate 244 is configured to move in the plane of the sliding plate 244 relative to the mounting pins 248 in the slots 262. The sliding plate 244 further includes mounting holes 264 configured to receive the fasteners 258 to rigidly mount holding clamp 242 to the sliding plate 244.

The sliding plate 244 includes a generally square or rectangular shape including a first side 266 and an opposite second side 268. The first side 266 the second side 268 may include features (e.g., an interlocking feature) for enabling the sliding plate 244 to be correctly positioned and locked into place during a manufacturing process, such as a printing operation. A process of aligning and positioning the golf ball holder 230 via movement of the sliding plate 244 is referred to herein as registration.

In an exemplary embodiment, the first side 266 may include a beveled or tapered edge 270 along a length of the first side 266. The beveled or tapered edge 270 may help align the first side 266 with a hold-down element for locking the sliding plate 244 in place. The second side 268 may include at least one notch 272. Each notch 272 may be an open-sided indent for receiving another component, such as a stationary pin, to ensure that the sliding plate is correctly "registered" or aligned relative to another component, such as a printing pad.

Figure 16:
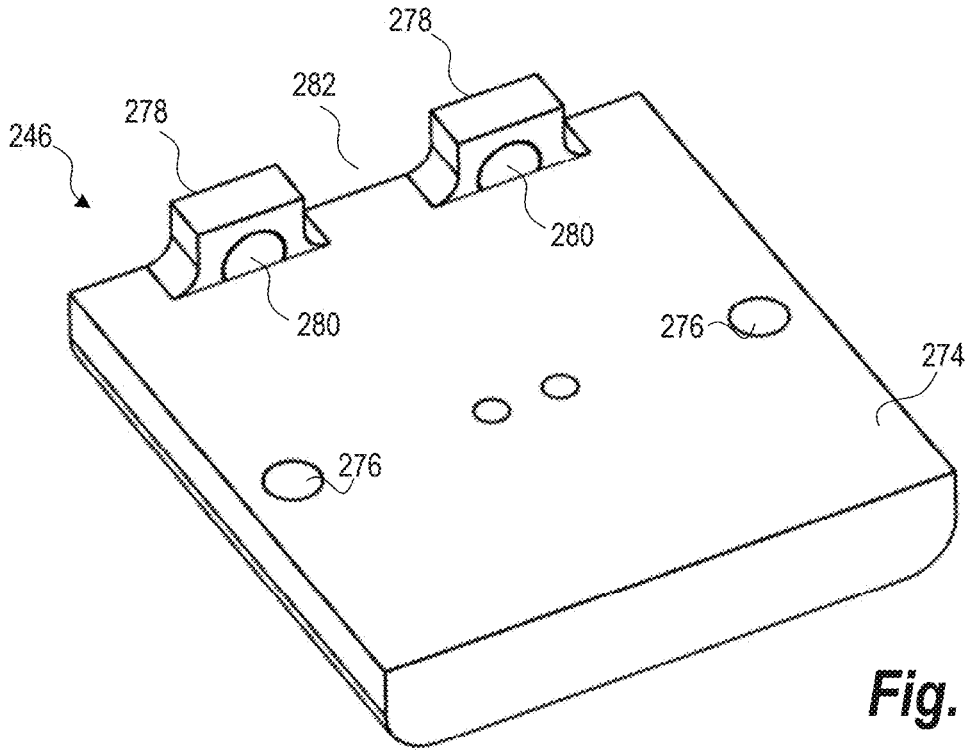
FIG. 16 is a top perspective view of a mounting plate, consistent with disclosed embodiments.

FIG. 16 further illustrates the mounting plate 246. The mounting plate 246 includes a top surface 274 and a bottom surface (not shown). The top surface 274 and the bottom surface may be flat surfaces. The sliding plate 244 is configured to rest on the top surface 274. The mounting plate 246 further includes at least one pin through hole 276 configured to receive the mounting pins 248. The mounting pins 248 pass through the pin through holes 276 without rigid attachment to thus enable the mounting plate 246 to move vertically relative to the mounting pins 248.

The mounting plate 246 further includes at least one raised stop 278 that protrudes above the top surface 274. The raised stop 278 may be configured to delimit a sliding range of the sliding plate 244 on the second side 268. In an exemplary embodiment, each raised stop 278 includes a magnetic element 280 therein. In an exemplary embodiment, the magnetic elements 280 are configured to attract at least a portion of the sliding plate 244 to urge the sliding plate 244 toward the raised stops 278. For example, the sliding plate 244 may be made from a magnetic material such as steel that is attracted to the magnetic elements 280. The raised stops 278 may be configured such that a gap 282 is formed therebetween. The gap 282 provides lateral access to the beveled edge 270 of the sliding plate 244.

Figure 17:
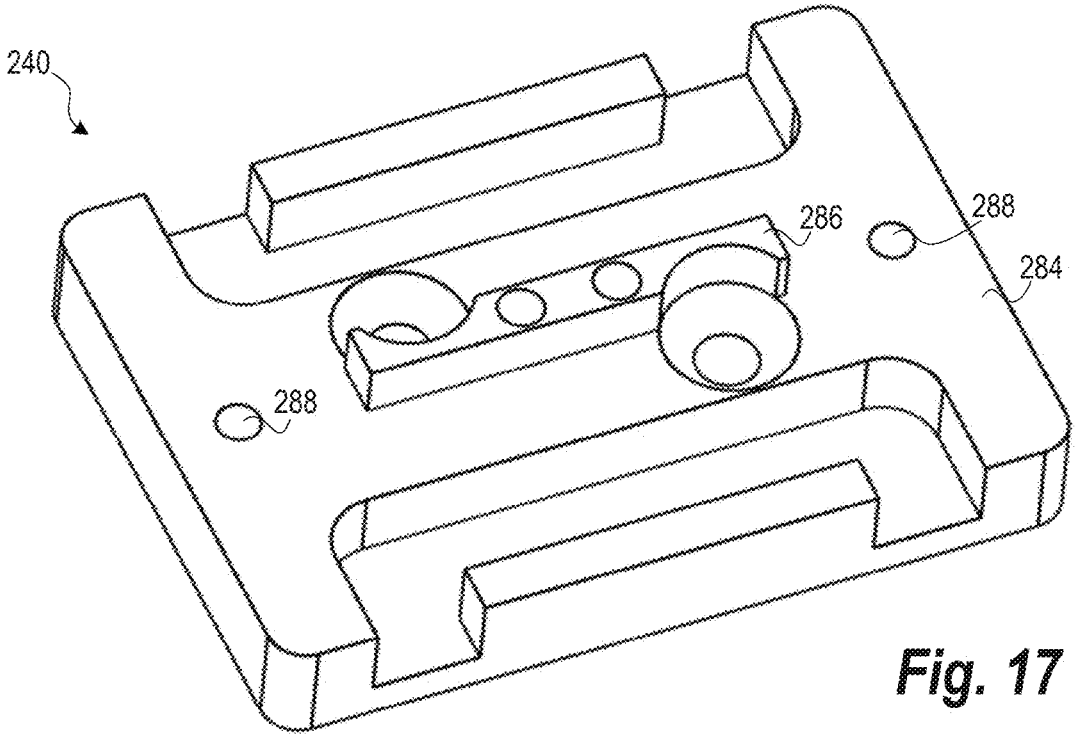
FIG. 17 is a top perspective view of a mount, consistent with disclosed embodiments.

FIG. 17 further illustrates the mount 240. The mount 240 includes a top surface 284 and a bottom surface (not shown). The mount 240 is configured to be mounted to the attachment member 238 of the shuttle 232. The mount 240 may include a protrusion 286 configured to fit within a surface slot in the bottom surface of the mounting plate 246. The mounting plate 246 is configured to rest on the top surface 284 of the mount 240 and move vertically relative to each other. The mount 240 further includes attachment holes 288 configured to receive threaded portions of mounting pins 248 for rigid attachment.

During operation of a golf ball transportation system including a golf ball holder 230 and shuttle 232 as described in the present disclosure, the shuttle 232 may transport a golf ball holder 230 to a station track for a manufacturing process, such as a printing operation. The vertically-movable mounting plate 246 and horizontally-movable sliding plate 244 may enable the golf ball holder 230 to move into different positions relative to the shuttle 232 during the manufacturing process. For example, the golf ball holder 230 may be moved vertically onto a support surface to remove load from the underlying shuttle 232 and also moved into a registration position to place the golf ball into a position directly under a printing pad of a printing station.

Figure 18:
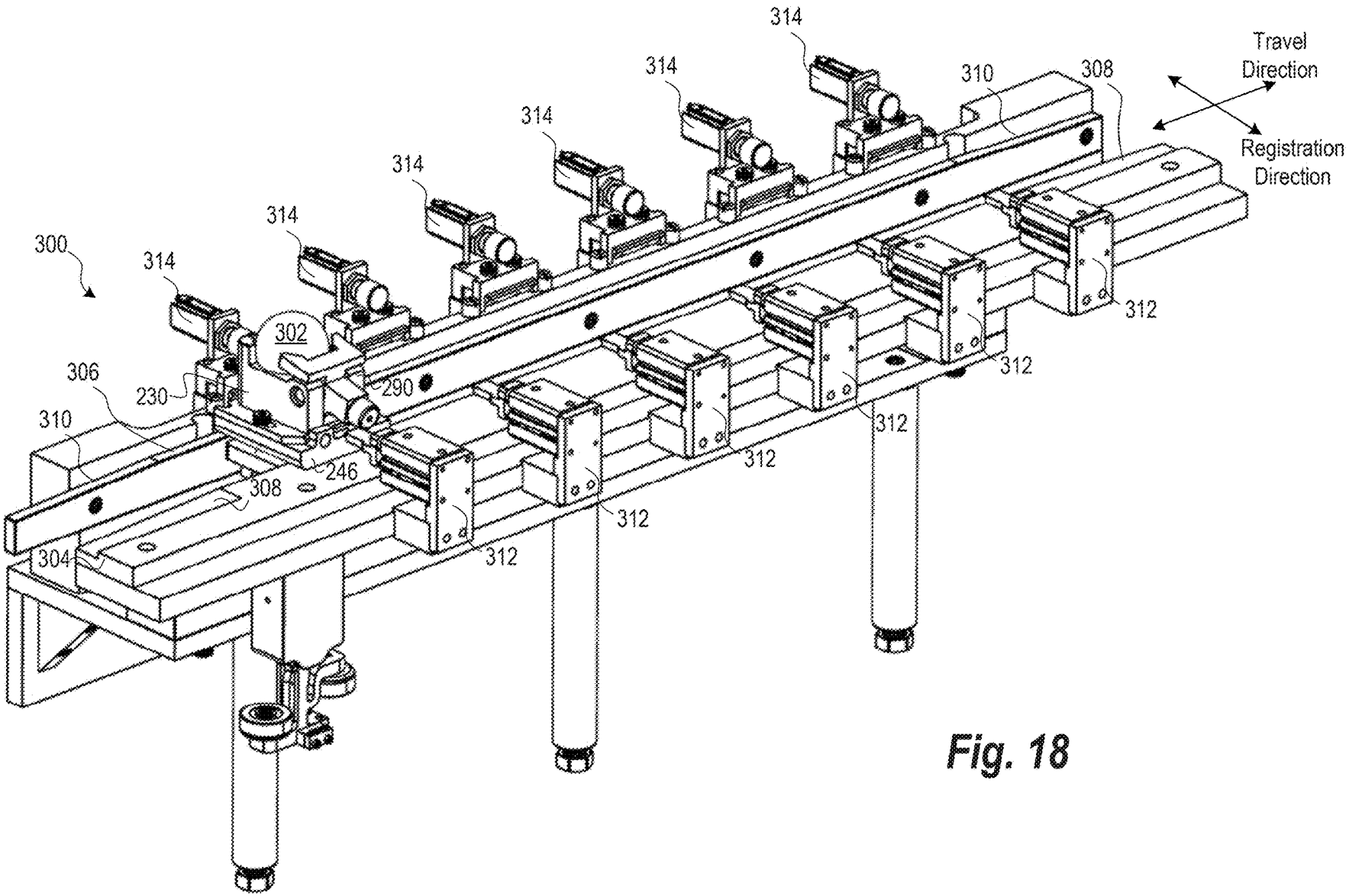
FIG. 18 is a perspective view of a registration system, consistent with disclosed embodiments.

FIG. 18 is a perspective view of a registration system 300 that may be used in conjunction with the golf ball transportation system 100 disclosed herein. The registration system 300 may be a segment of a disclosed station track and include components that enable a shuttle 232 carrying a golf ball holder 230 and a golf ball 302 to move into a registration position for a manufacturing step requiring the golf ball to be held still, such as a pad printing operation. In a particular example, the registration system 300 may be used in combination with components of a disclosed printing station, such as the printing pads 164 of the printing station 112 in FIG. 11. The registration system 300 may be further used in conjunction with disclosed track components configured to move the shuttle 232 through the registration system 300.

In an exemplary embodiment, the registration system 300 includes first side and a second side across from each other in a registration direction. The first side and the second side are separated from each other by a gap through which the shuttle 232 and a portion of the golf ball holder 230 may pass while moving in a travel direction that is different than the registration direction. In an exemplary embodiment, the travel direction and the registration direction are perpendicular to each other.

The registration system 300 may include a first support rail 304 on the first side and a second support rail 306 on the second side. The first support rail 304 includes a ramp portion 308 at both ends and the second support rail 306 includes a ramp portion 310 at both ends. The ramp portions 308, 310 enable the mounting plate 246 to vertically lift relative to the mounting plate 246 and shuttle 232 when transitioning from a different portion of track that does not have support rails. The ramp portions 308, 310 allow the mounting plate 246 to ride up onto flat portions of the first support rail 304 on the first side and the second support rail 306 on the second side. As a result, pressure and force applied to the golf ball 302, holding clamp 242, sliding plate 244, and/or mounting plate 246 (e.g., by a printing pad) are absorbed by the first and second support rails 304, 306 and not the shuttle 232 or its components.

The registration system 300 further includes an alignment mechanism including a push assembly 312 adjacent the first track 304 and return assembly 314 adjacent the second track 306. These and/or other components may be considered station features of the registration system 300. As the shuttle 232 moves in the travel direction along the first and second support rails 304, 306, the golf ball holder 230 may stop at a position along the travel direction that is in alignment with one of the pairings of push assembly 312 and return assembly 314. FIG. 18 shows one golf ball holder 230 that has arrived at a position between a first pairing of push assembly 312 and return assembly 314. The registration system 300 may include several pairings of push assembly 312 and return assembly 314 such that multiple shuttles 232 carrying multiple golf ball holders 230 may become aligned between the pairings simultaneously (similar to FIG. 3).

The alignment mechanism is configured to move a golf ball assembly 290 from a first position to a second position in the registration direction when the golf ball holder 230 is correctly aligned along the travel direction. As used herein, the term "golf ball assembly" refers to a combination of at least the sliding plate 244, holding clamp 242, and golf ball 302. In some embodiments in which a sliding plate 244 and holding clamp 242 are integrally formed as one piece, that component alone and a golf ball may be considered the golf ball assembly. The golf ball assembly 290 is movable between at least a first position and a second position in the registration direction. The position depicted in FIG. 18 may also be considered a first position of the golf ball holder 230. When the golf ball holder 230 is in the first position, the associated golf ball assembly 290 and each of the associated components (sliding plate 244, holding clamp 242, and golf ball 302) are also considered to be in the first position.

Figure 19:
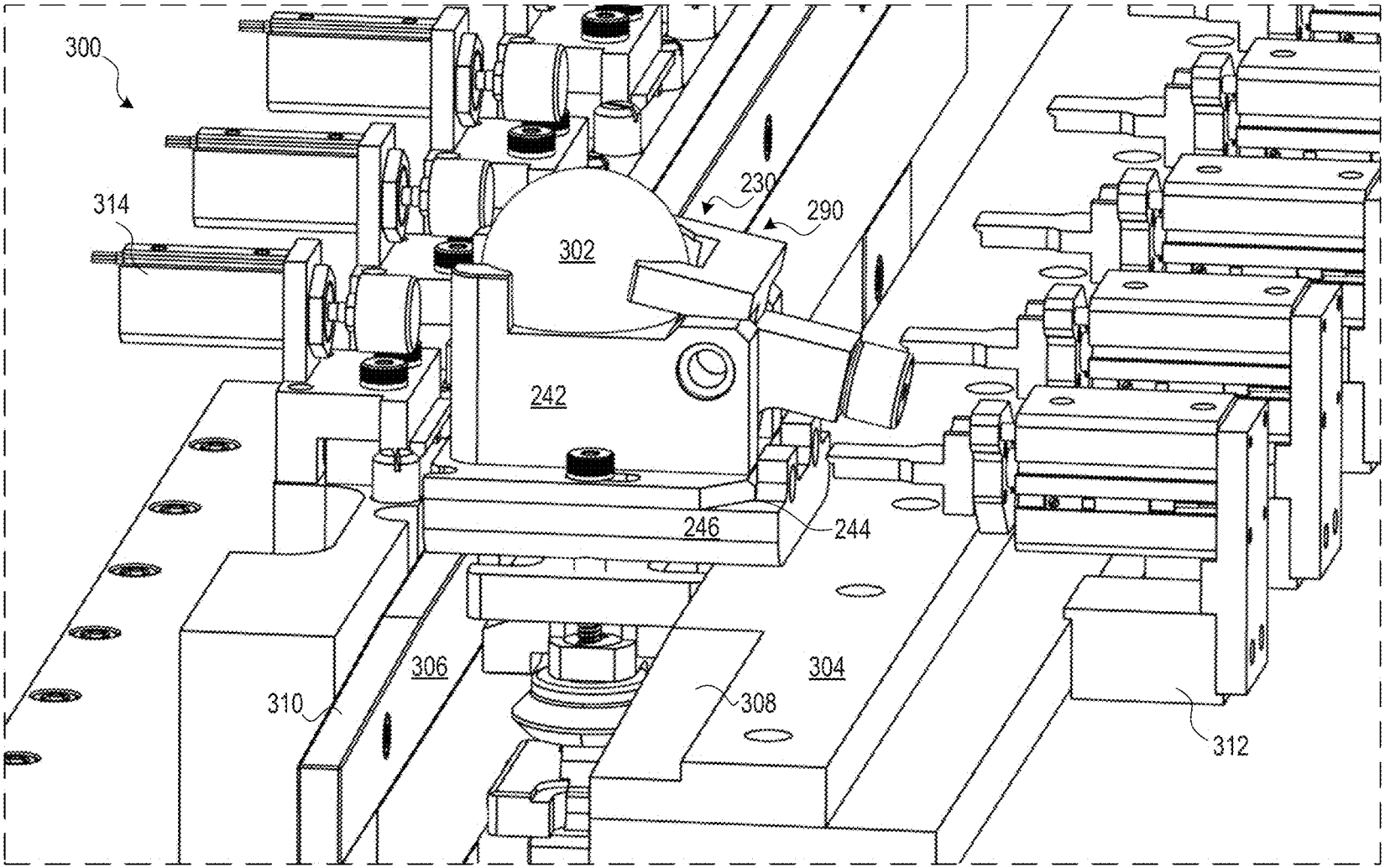
FIG. 19 is a close-up view of a golf ball holder in a first position in the registration system of FIG. 18.

FIG. 19 is another perspective view of the registration system 300 showing the golf ball assembly 290 in the first position. The alignment mechanism may be configured to move the sliding plate 244, holding clamp 242, and golf ball 302 to place the golf ball assembly 290 (and thus the golf ball holder 230) in the second position. The golf ball assembly 290 may be held at the second position for a manufacturing step, such as a pad print onto an exposed surface of the golf ball 302.

Figure 20:
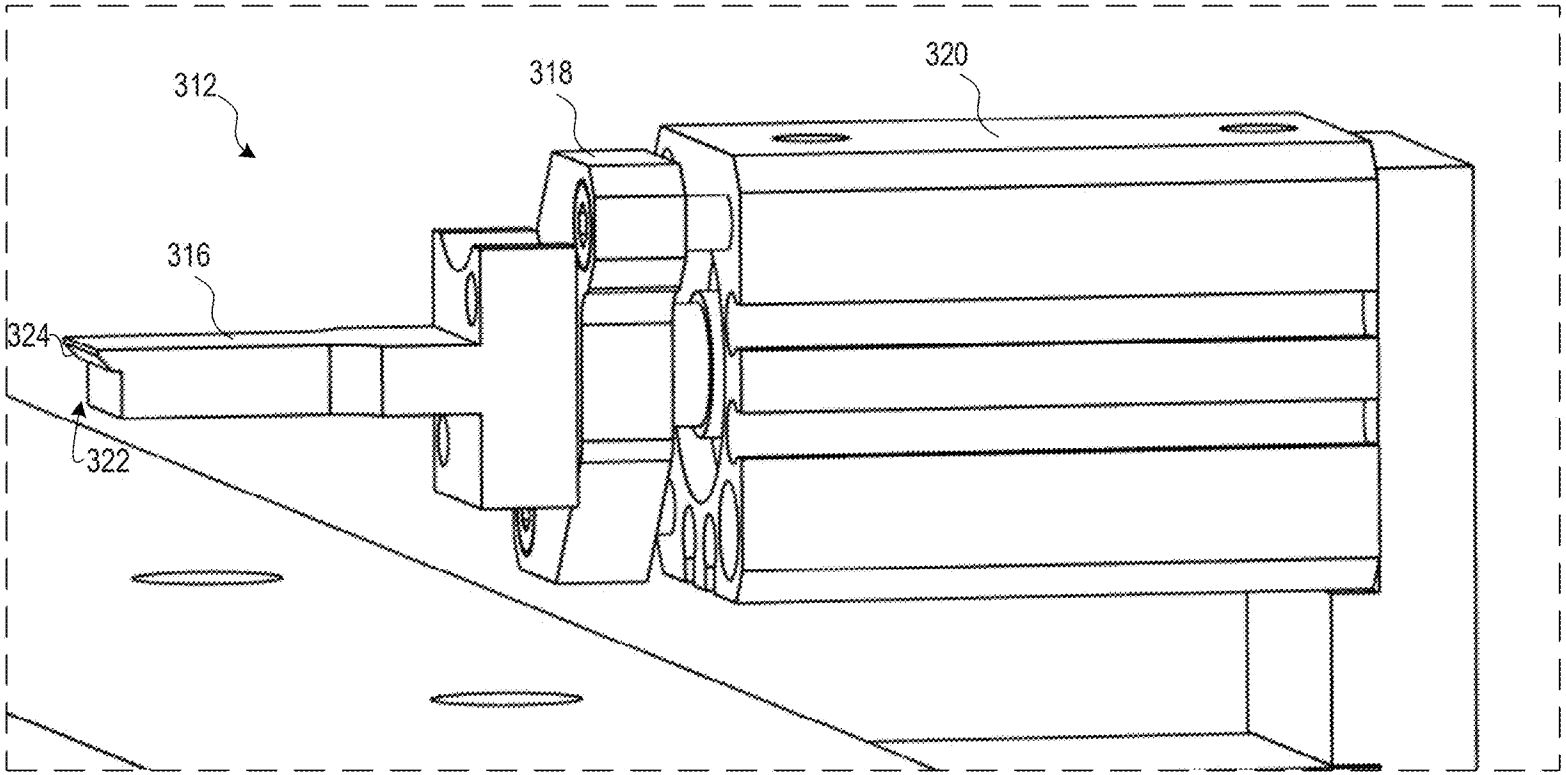
FIG. 20 is a push assembly of the registration system of FIG. 18, consistent with disclosed embodiments.

FIG. 20 is a perspective view of the push assembly 312. The push assembly 312 may include a push arm 316, a mount 318, and an actuator 320. The push arm 316 includes a distal end having an engagement surface 322 and a proximal end attached to the mount 318. The engagement surface 322 is configured to contact the beveled edge 270 of the sliding plate 244. In some embodiments, the engagement surface 322 may include an overhang 324 configured to contact and apply force to the beveled edge 270 of the sliding plate 244, such as to hold the first side 266 of the sliding plate 244 in position. The mount 318 is functionally coupled with the actuator 320 such that the actuator 320 is configured to move the mount 318 and push arm 316 in a linear direction (i.e., the registration direction). The actuator 320 may be electronically controlled via, for example, motors, hydraulics, pneumatics, etc.

Figure 21:
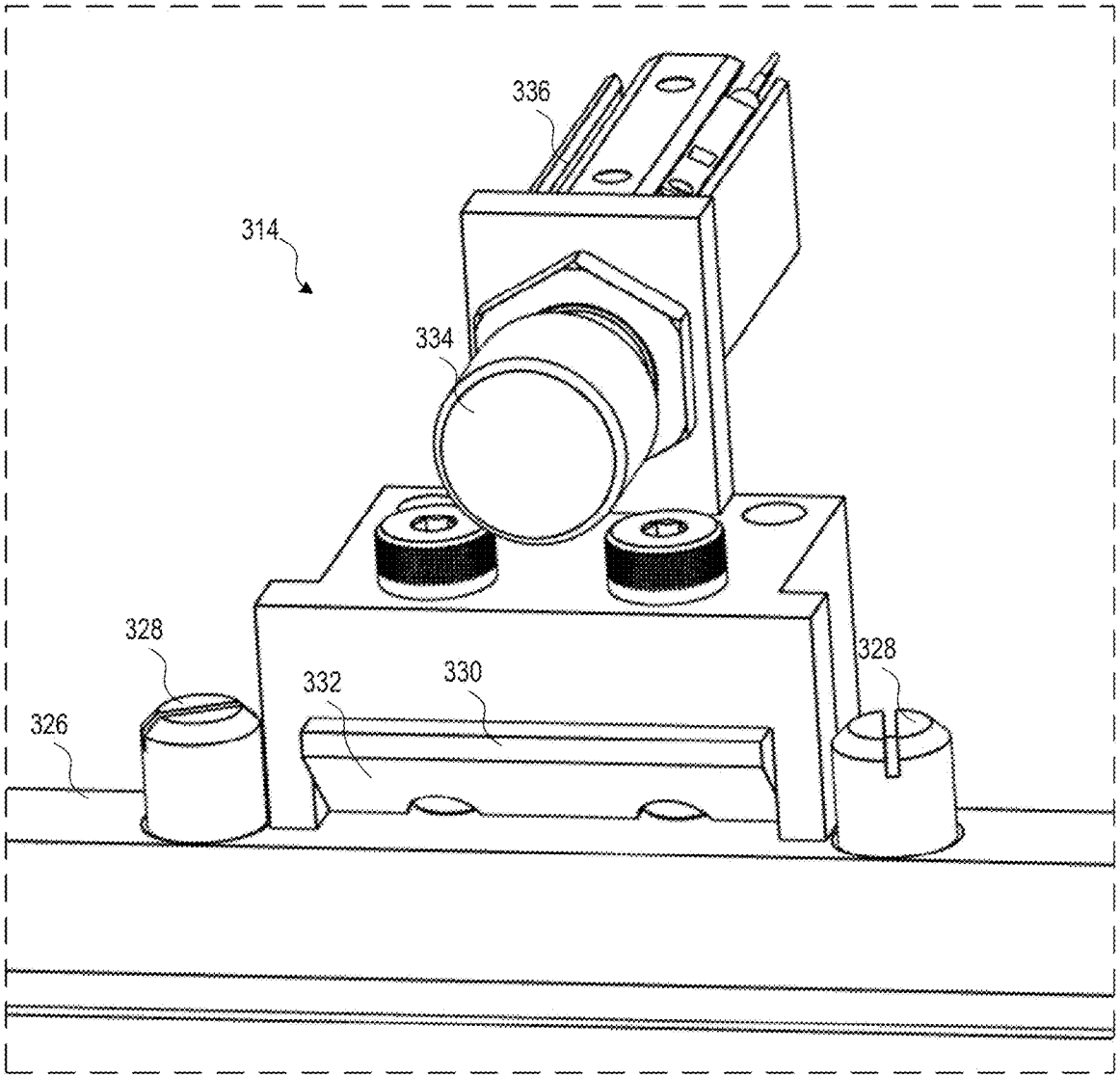
FIG. 21 is a return assembly of the registration system of FIG. 18, consistent with disclosed embodiments.

FIG. 21 is a perspective view of the return assembly 314. The return assembly 314 is configured to engage with the golf ball holder 230 in order to help position the sliding plate 244 (and, as a result, the golf ball 302) relative to another component, such as a printing pad. The return assembly 314 may also be configured to contact the second side 268 of the sliding plate 244 to hold the second side 268 in position. In some embodiments, the return assembly 314 may be configured to urge the sliding plate 244 back to the first position (e.g., after a manufacturing step is completed).

The registration system 300 may include a printer registration plate 326. The second support rail 306 and each of the return assemblies 314 are attached to the printer registration plate 326. The return assembly 314 includes at least one stationary pin 328 attached to the printer registration plate 326. For example, the return assembly 314 includes a pair of stationary pins 328. Each stationary pin 328 is positioned to be received by a corresponding notch 272 of the sliding plate 244 to ensure that the sliding plate 244 is accurately moved into in the second position. In some embodiments, the notch 272 and stationary pin 328 may be reversed such that the sliding plate includes at least one pin and the return assembly 314 includes at least one notch. The combination of pin and notch are an example of an interlocking feature that may is configured to help ensure that the golf ball holder 230 is correctly positioned when the sliding plate 244 is moved in the registration direction.

The return assembly 314 further includes a hold down 330 configured to contact the second side 266 of the sliding plate 244. In an exemplary embodiment, the hold down 330 includes a recessed surface 332 configured to contact the sliding plate 244 and restrain the sliding plate 244 from rotating or lifting upward. For example the recessed surface 332 may be a slot configured to receive a portion of the sliding plate 244 moving toward the hold down 330. The recessed surface 332 may thereby capture a portion of the sliding plate 244 to restrain upward or downward movement of the sliding plate 244. In other embodiments, the recessed surface 332 may be an angled surface that contacts the sliding plate 244 and guides the sliding plate 244 into position while restraining upward and downward movement.

In some embodiments, the return assembly 314 may also include a return bumper 334. The return bumper 334 may be functionally connected to an actuator 336 that is configured to move the bumper 334 toward the golf ball holder 230 to urge the sliding plate 244 from the second position back to the first position.

Figure 22:
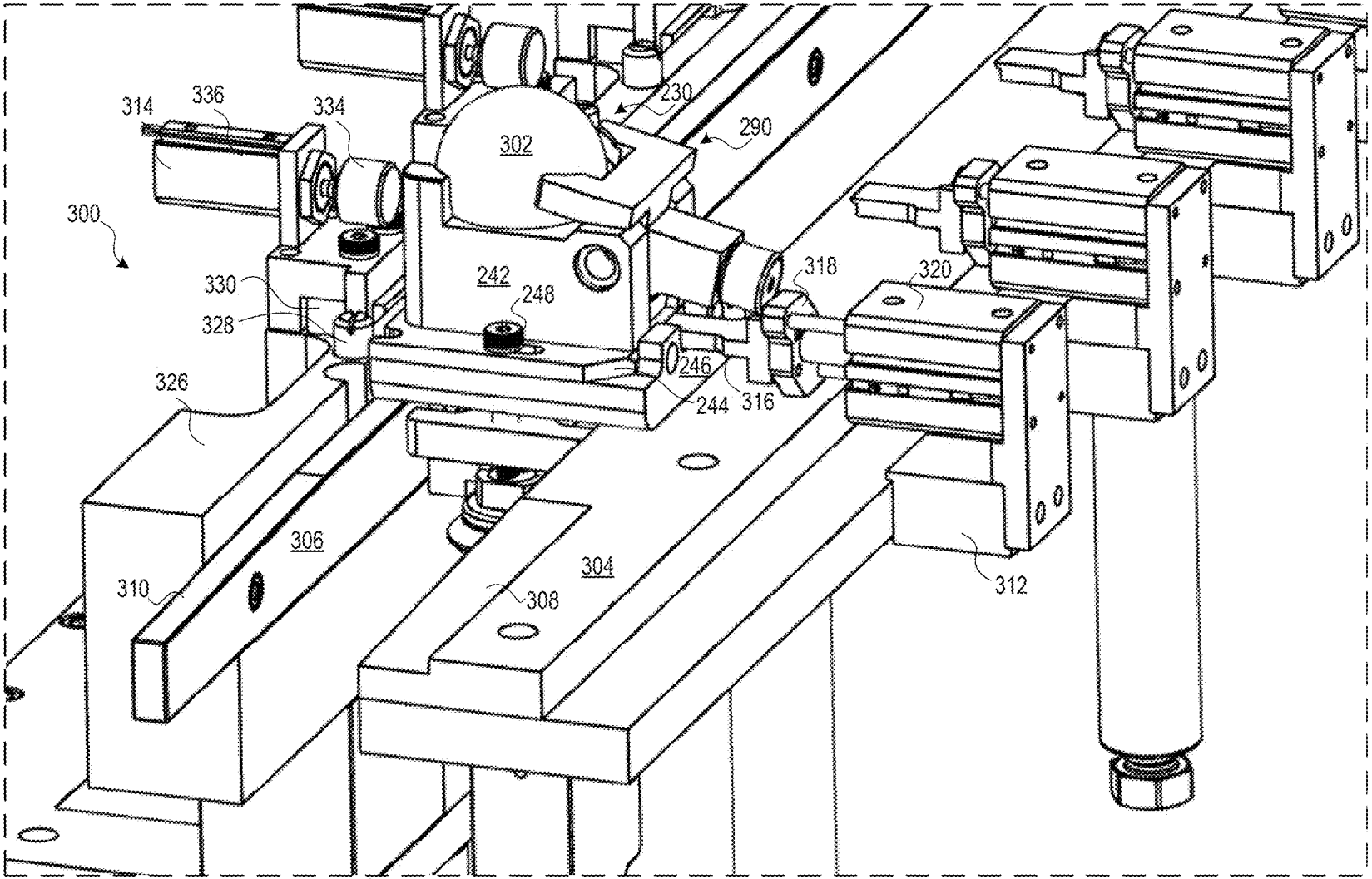
FIG. 22 is another view of the golf ball holder of FIG. 19, with a push arm of a push assembly in an extended position, consistent with disclosed embodiments.
Figure 23:
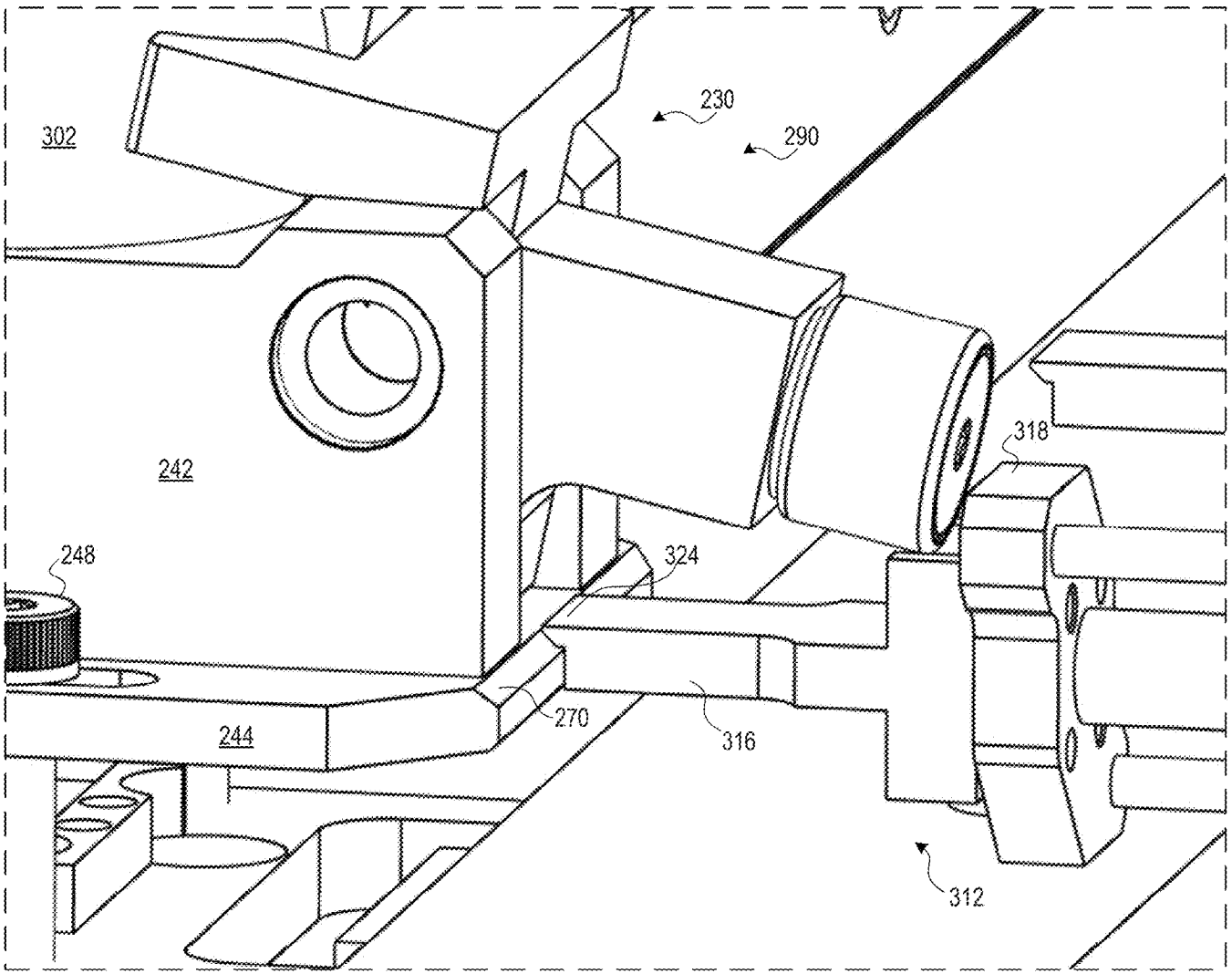
FIG. 23 is a close-up view of the push arm in the extended position as in FIG. 22, with a mounting plate hidden.

FIG. 19 shows the mounting plate 246 on the first and second support rails 304, 306 and therefore lifted vertically off of the mount 240. In addition, FIG. 19 shows the ball assembly 290 in the first position. In the first position, the ball assembly 290 is not in contact with the return assembly 314. In FIG. 19, the push arm 316 is in a retracted position and therefore not in contact with the ball assembly 290. In FIG. 22, the ball assembly 290 remains in the first position but the push arm 316 has been moved to an extended position by the actuator 320 and is in contact with the first side 266 of the sliding plate 244. The push arm 316 extends through the gap 282 between the raised stops 278 of the mounting plate 246 to contact the sliding plate 244. In FIG. 23, the mounting plate 246 is hidden to show the contact between the push arm 316 and the sliding plate 244. As shown, the overhang 324 mates with the beveled edge 270 to provide multi-planar contact and help prevent the first side 266 of the sliding plate 244 from lifting upward further.

Figure 24:
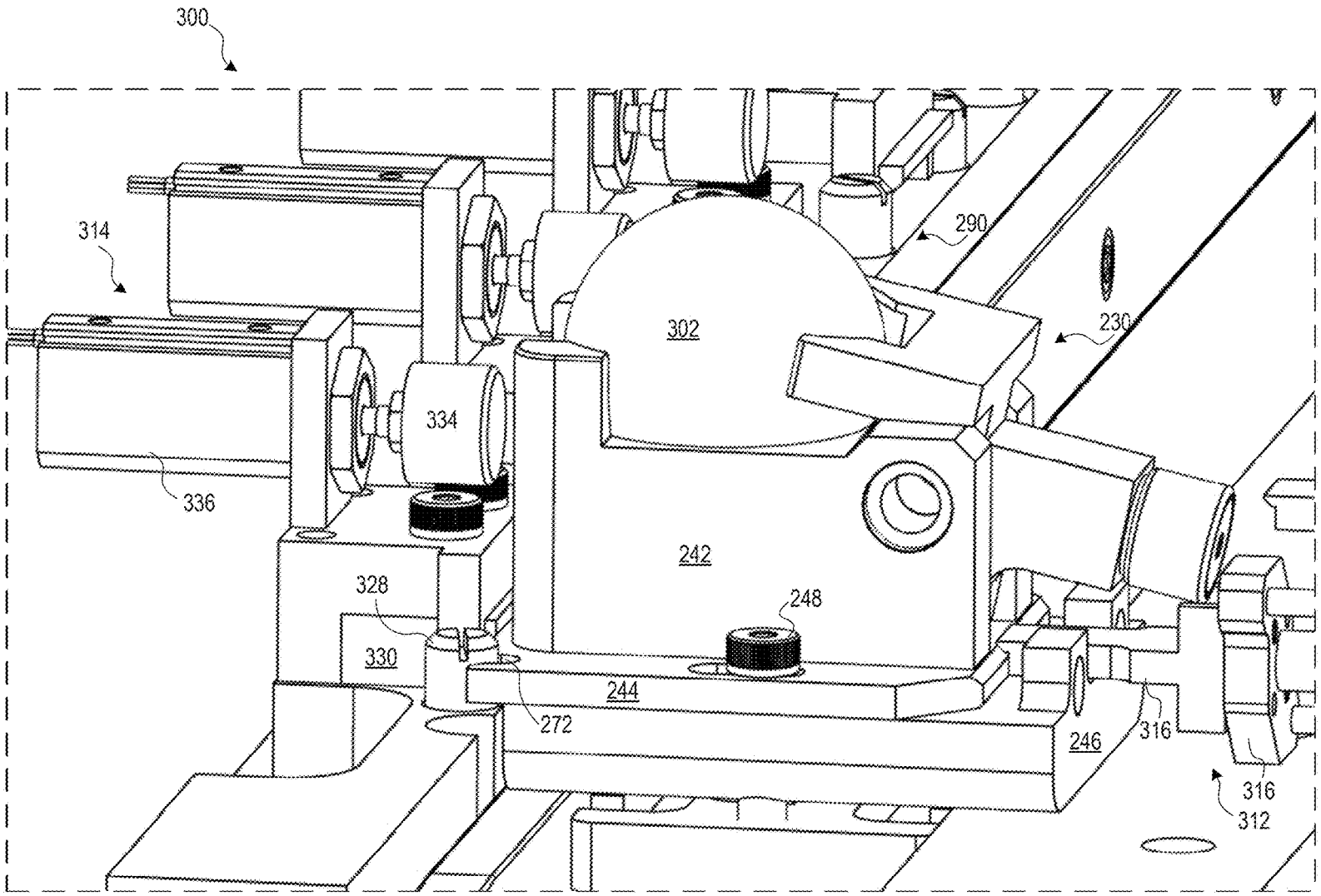
FIG. 24 is a close-up view of the golf ball holder in a second position in the registration system of FIG. 18, consistent with disclosed embodiments.

The actuator 320 is configured to continue to move the push arm 316 to force the sliding plate 244 toward and into contact with the return assembly 314, thereby placing the sliding plate 244 and ball assembly 290 in the second position. FIG. 24 shows the sliding plate 244 and ball assembly 290 in the second position.

FIGS. 25-29 further depict the return assembly 314 to show the behavior of the an embodiment of the hold down 330 when the sliding plate 244 moves from the first position to the second position. While the hold down 330 is depicted as having moving components, it should be understood that the hold down 330 may be a solid stationary component in some embodiments. In other embodiments, the hold down may include a cam mechanism.

In the embodiment shown in FIGS. 25-29, includes a spring housing 338, a spring retractor 340, and a pair of shoulder pins 342. The shoulder pins 342 are attached to and/or stationary relative to the spring housing 338 and extend through openings in the spring retractor 340 that are wider than the shoulder pins 342. As a result, the spring retractor 340 can move in a lateral direction (e.g., the registration direction) relative to the shoulder pins 342.

Figure 25:
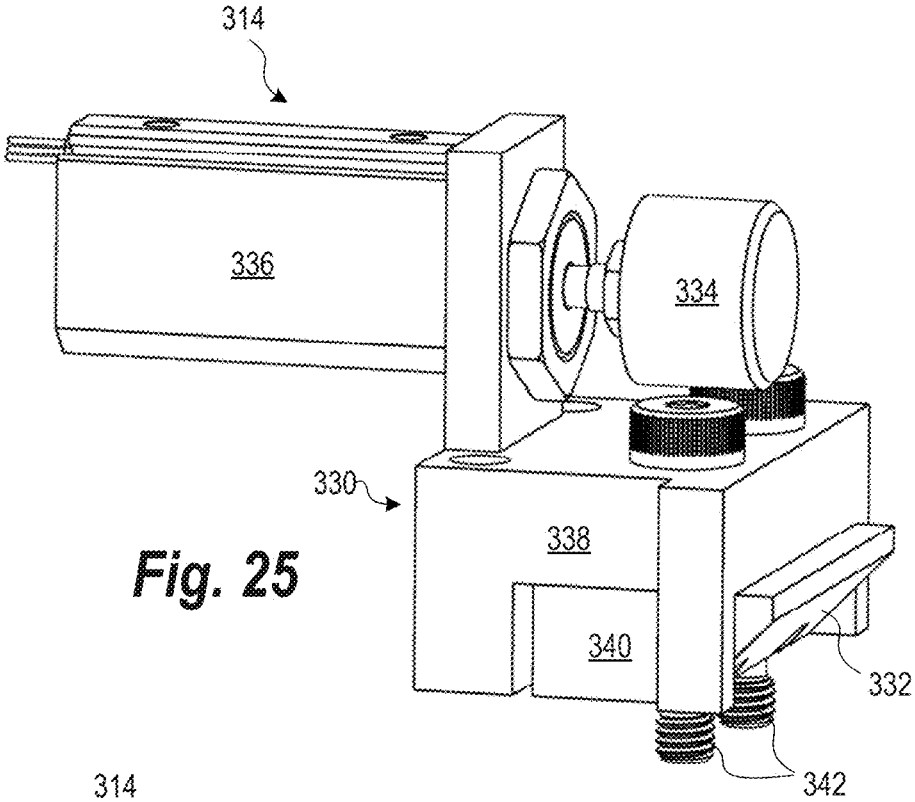
FIG. 25 is a perspective view of a return assembly with a spring retractor in a released position, consistent with disclosed embodiments, consistent with disclosed embodiments.
Figure 26:
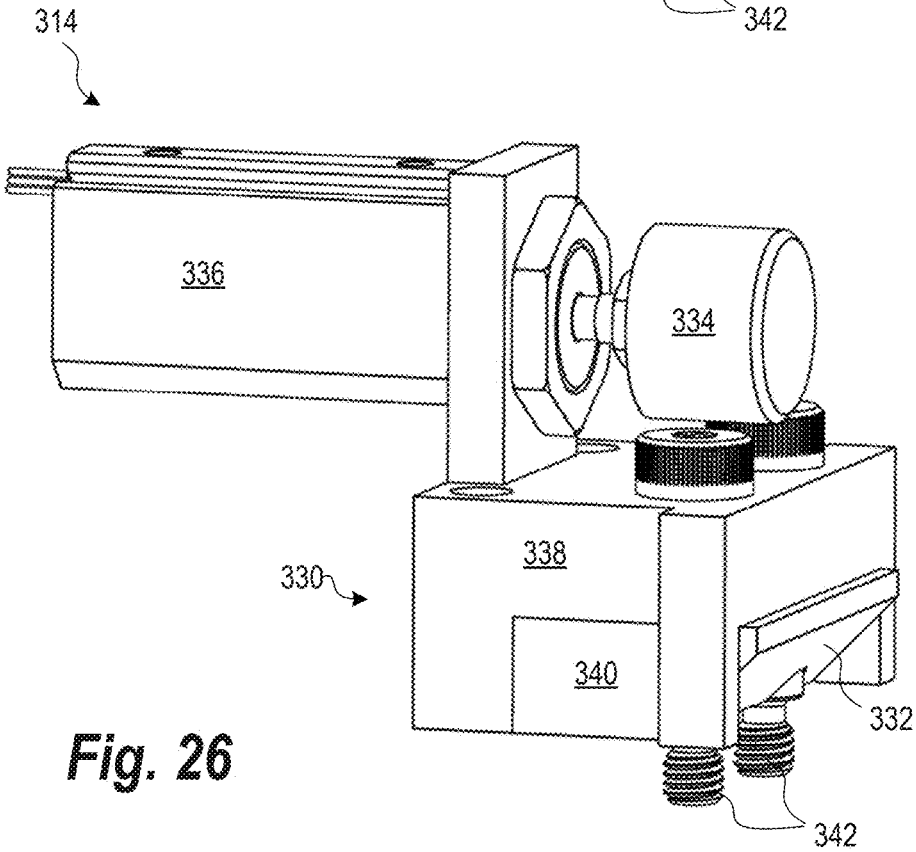
FIG. 26 is another perspective view of the return assembly of FIG. 25, with the spring retractor in a compressed position, consistent with disclosed embodiments.
Figure 28:
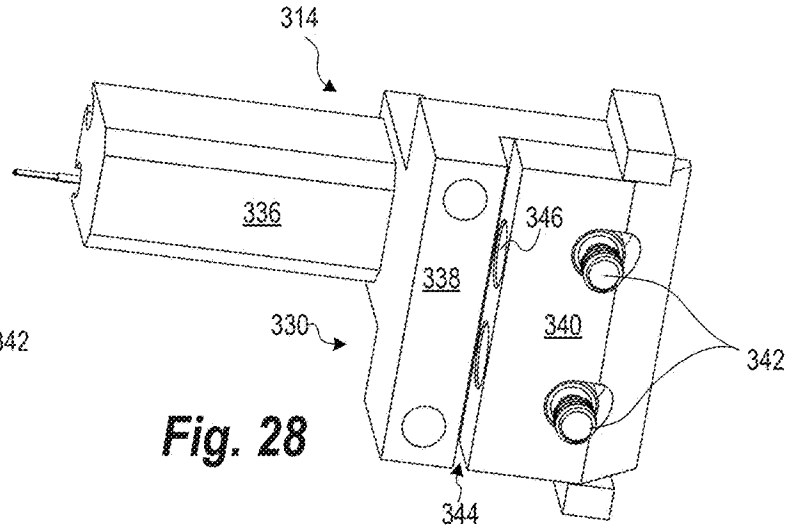
FIG. 28 is a second bottom view of the return assembly of FIG. 25, with the spring retractor in the released position.
Figure 27:
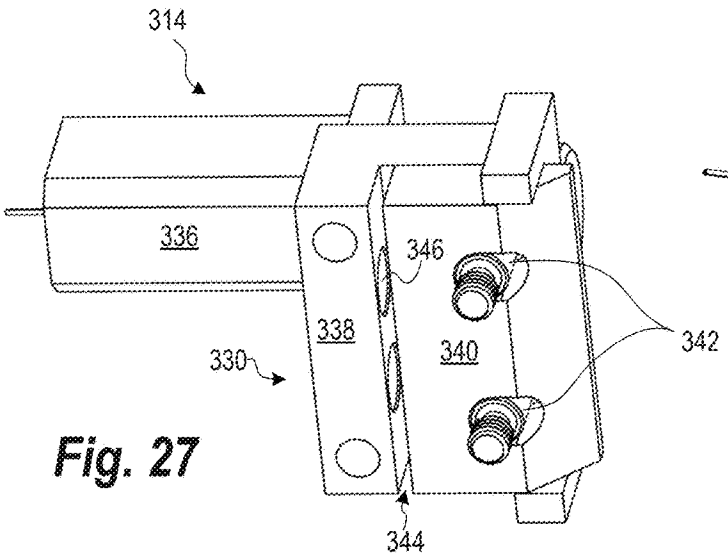
FIG. 27 is a first bottom view of the return assembly of FIG. 25 with the spring retractor in the released position.
Figure 29:
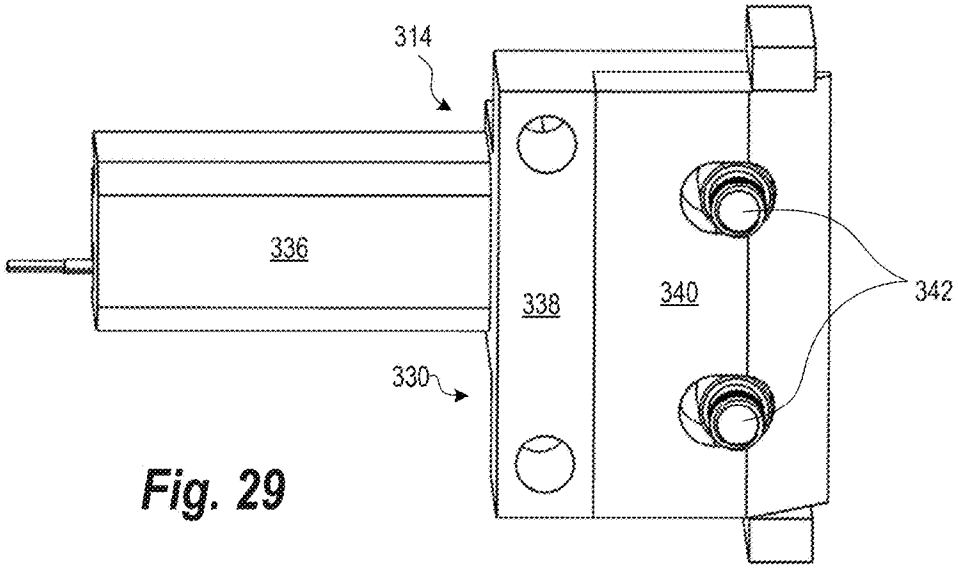
FIG. 29 is a third bottom view of the return assembly of FIG. 25, with the spring retractor in the compressed position.

In a released position shown in FIGS. 25, 27, and 28 the spring retractor 340 is extended out away from the spring housing 338 and a gap 344 is present between a back of the spring retractor 340 and the spring housing 338. A spring mechanism 346 may be present in or near the gap 344 to urge the spring retractor into the released position. The spring mechanism 346 may be, for example, a coil spring or a pairing of repelling magnets or magnetic elements. As the push arm 316 continues to push the sliding plate 244 toward the return assembly 314, the sliding plate 244 eventually contacts and forces the spring retractor 340 into the spring housing 338 that shrinks the gap 344 and moves the spring retractor 340 to a compressed position shown in FIGS. 26 and 29.

Figure 30:
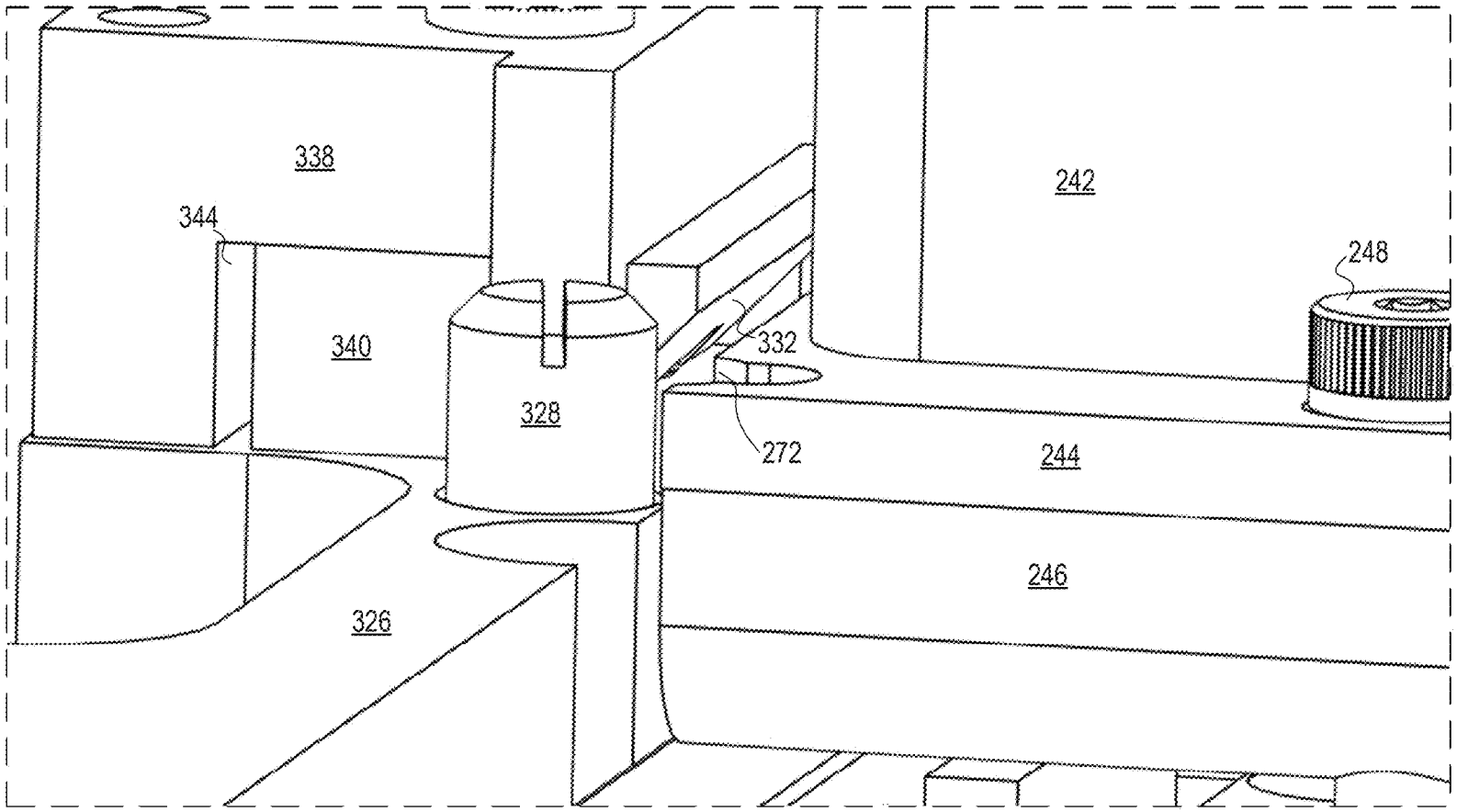
FIG. 30 is a close-up view of the golf ball holder in the first position and the spring retractor in the released position in the registration system of FIG. 18, consistent with disclosed embodiments, consistent with disclosed embodiments.
Figure 31:
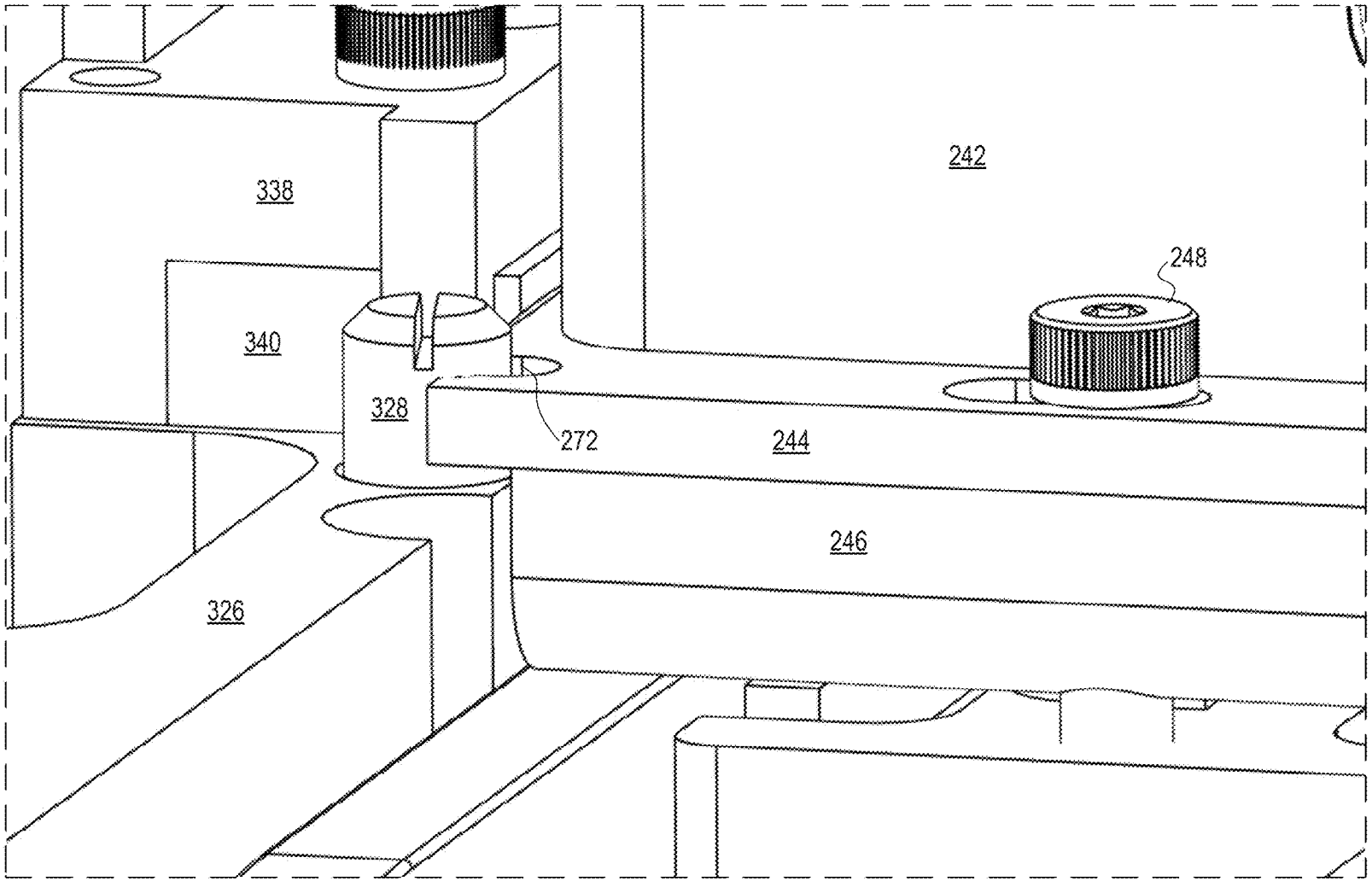
FIG. 31 is a close-up view of the golf ball holder in the second position and the spring retractor in the compressed position, consistent with disclosed embodiments.

FIG. 30 further depicts a close-up view of the sliding plate 244 in the first position and the spring retractor 340 in the released position. FIG. 31 further depicts the close-up view with the sliding plate 244 moved to the second position and the spring retractor 340 in the compressed position. It can be seen that the mounting plate 246 remains in the same position even as the golf ball assembly 290 is moved between the first and second positions. In the second position shown in FIGS. 24 and 31, the push assembly 312 is in contact with the first side 266 of the sliding plate 244 and the return assembly 314 is in contact with the second side 268 of the sliding plate 244. The engagement surface 322 and the recessed surface 332 combine to provide vertical leverage over the opposing sides 266, 268 of the sliding plate 244 to inhibit the sliding plate 244 from rotating or lifting from the second position. Further, in the second position, it can be seen that the stationary pin 328 is received by the notch 272 of the sliding plate 244, thereby ensuring that the golf ball 302 is positioned as desired.

Disclosed embodiments include a transportation system including a primary track and a plurality of station tracks. At least one of the station tracks may be adjacent to a registration system as disclosed. The registration system may be positioned relative to the station track in order to control the positioning of items (e.g., golf balls). The transportation system may be used to complete a manufacturing process, such as a printing operation. In an exemplary process, at least one golf ball holder travels along the station track in a travel direction via an attached shuttle and then transitions onto the first and second support rails of the registration system via the ramp portions. The mounting plate of the golf ball holder is thereby lifted and supported on the support rails. The shuttle continues travel to align the golf ball holder with an alignment mechanism of the registration system. The alignment mechanism is thereafter actuated to cause the golf ball holder to move from a first position to a second position in a registration direction that is different than the travel direction. For example, a push arm moves from a retracted position to an extended position to contact a sliding plate and urge the golf ball holder into the second position.

In the second position, the golf ball holder is engaged with at least a portion of a return assembly. For example, an interlocking pin and notch may ensure that the golf ball holder is properly oriented and located in the second position. In the second position, a manufacturing operation, such as printing via a printing pad, may occur. The disclosed alignment mechanism of a registration system includes features to provide leverage to both sides of the golf ball holder. For example, the engagement surface of the push arm on one side and the recessed surface of a hold down on the opposite side may lock the golf ball holder in position such that subsequent manufacturing processes (e.g., pad printing) can be completed without risk of golf ball movement or misalignment. After the manufacturing operation is complete, the golf ball holder may be returned to the first position.

In some embodiments, retraction of the push arm out of contact with the golf ball holder may be sufficient to cause the golf ball holder to return to the first position via attraction of corresponding magnets on the sliding plate and mounting plate. In some embodiments an actuator may cause a return bumper to urge the golf ball holder back to the first position. In the first position, the golf ball holder may move again in the travel direction along the track via the attached shuttle. For example, the shuttle may move the golf ball holder off of the station track, back to the main track, and then to another station track (e.g., an offloading station) to continue a golf ball manufacturing process.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

The invention claimed is:

1. A system for transporting a golf ball, comprising:

at least one track;

a shuttle configured to be attached to the track for movement along the track in a travel direction;

a golf ball holder attached to the shuttle, the golf ball holder configured to maintain an orientation of a golf ball, wherein the golf ball holder comprises a sliding plate; and a registration system configured to move the golf ball holder from a first position to a second position in a registration direction that is different than the travel direction, wherein the registration system comprises a push assembly configured to apply a force to the golf ball holder by contacting and pushing to move the golf ball holder from the first position to the second position, wherein the push assembly comprises a push arm configured to move in the registration direction between a retracted position and an extended position in contact with the golf ball holder, wherein the push arm is configured to contact the sliding plate, wherein the push arm comprises a distal end having an overhang configured to provide multi-planar contact with the sliding plate, and wherein the sliding plate comprises a beveled edge having a shape configured to mate with the overhang of the push arm.

2. The system of claim 1, wherein the registration direction is perpendicular to the travel direction.

3. The system of claim 1, wherein the sliding plate is configured to move in the registration direction relative to the shuttle.

4. The system of claim 3, wherein the golf ball holder further comprises at least one mounting fastener rigidly connected to the shuttle, wherein the sliding plate is configured to move in the registration direction relative to the at least one mounting fastener.

5. The system of claim 1, wherein the push assembly further comprises an actuator configured to move the push arm in the registration direction to thereby move the golf ball holder in the registration direction between the first position and the second position.

6. The system of claim 1, wherein the registration system further comprises a return assembly configured to engage the golf ball holder in the second position.

7. The system of claim 6, wherein the return assembly comprises an interlocking feature configured to mate with a corresponding feature of the golf ball holder when the golf ball holder is in the second position.

8. The system of claim 7, wherein the interlocking feature comprises one of a pin or notch, and the golf ball holder comprises the other of the pin or notch.

9. The system of claim 8, wherein the notch is configured to receive the pin when the golf ball holder is in the second position.

10. The system of claim 6, wherein the return assembly comprises a hold down configured to contact the golf ball holder.

11. The system of claim 10, wherein the golf ball holder comprises a sliding plate and the hold down comprises a recessed surface configured to contact the sliding plate and restrain the sliding plate from rotating or lifting upward.

12. The system of claim 6, wherein the return assembly comprises a bumper configured to urge the golf ball holder from the second position back to the first position.

13. A system for transporting a golf ball, comprising:

at least one track;

a shuttle configured to be attached to the track for movement along the track in a travel direction;

a golf ball holder attached to the shuttle and configured to maintain an orientation of the golf ball, the golf ball holder comprising a sliding plate configured to move the golf ball holder from a first position to a second position in a registration direction that is different than the travel direction; and a registration system positioned adjacent to the at least one track, the registration system comprising:

a push arm on a first side of the track configured to contact a first end of the sliding plate to move the golf ball holder from the first position to the second position in the registration direction;

an interlocking feature on a second, opposite side of the track configured to mate with a corresponding feature on the golf ball holder when the golf ball holder is in the second position; and a hold down on the second side of the track configured to contact a second end of the sliding plate and restrain the sliding plate from rotating or lifting upward when the golf ball holder is in the second position.

14. The system of claim 13, further comprising a printing station positioned adjacent to the at least one track, the printing station comprising at least one printing pad configured to print on a golf ball held by the golf ball holder when the golf ball holder is in the second position.

15. A system for transporting a golf ball, comprising:

at least one track;

a shuttle configured to be attached to the track for movement along the track in a travel direction;

a golf ball holder attached to the shuttle, the golf ball holder configured to maintain an orientation of a golf ball, wherein the golf ball holder comprises a sliding plate; and a registration system configured to move the golf ball holder from a first position to a second position in a registration direction that is different than the travel direction, wherein the registration system comprises:

a push assembly configured to apply a force to the golf ball holder to move the golf ball holder from the first position to the second position; and a return assembly configured to engage the golf ball holder in the second position, wherein the return assembly comprises:

a hold down configured to contact the golf ball holder, the hold down comprising a recessed surface configured to contact the sliding plate and restrain the sliding plate from rotating or lifting upward.

16. A system for transporting a golf ball, comprising:

at least one track;

a shuttle configured to be attached to the track for movement along the track in a travel direction;

a golf ball holder attached to the shuttle, the golf ball holder configured to maintain an orientation of a golf ball; and a registration system configured to move the golf ball holder from a first position to a second position in a registration direction that is different than the travel direction, wherein the registration system comprises:

a push assembly configured to apply a force to the golf ball holder to move the golf ball holder from the first position to the second position; and a return assembly configured to engage the golf ball holder in the second position, wherein the return assembly comprises a bumper configured to urge the golf ball holder from the second position back to the first position.

* * * * *